US005130226A

United States Patent [19]

Sampei et al.

[11] Patent Number: 5,130,226

[45] Date of Patent: Jul. 14, 1992

[54] SILVER HALIDE PHOTOGRAPHIC LIGHT-SENSITIVE MATERIAL

[75] Inventors: Takeshi Sampei; Akira Ogasawara, both of Hino; Miho Sai, Tokyo; Yoji Hara, Hachioji, all of Japan

[73] Assignee: Konica Corporation, Tokyo, Japan

[21] Appl. No.: 758,206

[22] Filed: Sep. 12, 1991

Related U.S. Application Data

[63] Continuation of Ser. No. 523,390, May 15, 1990, abandoned.

[30] Foreign Application Priority Data

May 25, 1989 [JP] Japan ..... 1-133892
Jul. 3, 1989 [JP] Japan ..... 1-172575

[51] Int. Cl.[5] ..... G03C 1/34

[52] U.S. Cl. ..... 430/264; 430/598; 430/607

[58] Field of Search ..... 430/264, 436, 440, 598, 430/607

[56] References Cited

U.S. PATENT DOCUMENTS

| | | | |
|---|---|---|---|
| 2,419,975 | 5/1947 | Trivelli et al. | 96/6 |
| 3,128,183 | 4/1964 | Jones et al. | 96/107 |
| 3,236,652 | 2/1966 | Kennard et al. | 96/109 |
| 3,457,079 | 7/1969 | Koda et al. | 96/109 |
| 4,221,857 | 9/1980 | Okutsu et al. . | |
| 4,252,893 | 2/1981 | Iwamuro et al. | 430/504 |
| 4,385,108 | 5/1983 | Takagi et al. . | |
| 4,618,574 | 10/1986 | Cavallaro . | |
| 4,686,167 | 8/1987 | Resnick et al. | 430/264 |
| 4,816,373 | 3/1989 | Ohashi et al. | 430/264 |
| 4,914,002 | 4/1990 | Inoue et al. | 430/264 |

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

A silver halide photographic light-sensitive material suitable for photomechanical process is disclosed. The light-sensitive material comprises a support and a silver halide emulsion layer and the emulsion layer or a layer adjacent to the emulsion layer contains a compound represented by formula 1, 2 or 3 and a compound represented by formula 4 or 5.

(1)

(2)

(3)

(4)

(5)

The light-sensitive material give extreme high contrast images by processing usung a stable developer and is inhibited from producing pepper fog.

14 Claims, No Drawings

SILVER HALIDE PHOTOGRAPHIC LIGHT-SENSITIVE MATERIAL

This application is a continuation of application Ser. No. 07/523,390, filed May 15, 1990, now abandoned.

FIELD OF THE INVENTION

This invention relates to a silver halide photographic light-sensitive material capable of forming superhigh contrast photographic images and, more particularly, to a silver halide photographic light-sensitive material which is highly worth being used in graphic art field and is capable of forming) high-contrast half-dot images with the use of a developer relatively excellent in preservability.

BACKGROUND OF THE INVENTION

Photomechanical processing steps include a step for converting a continuous tone original document into a half-tone dot image, that is, a step for converting a continuous tone density variation into a group of half-tone dots each having an area in proportion as the densities are varied.

In the steps, a photographic technique capable of reproducing superhigh contrast images has been used, namely, a technique in which an original picture is photographed through an intersecting line screen or a contact screen and is then treated in an infectious development.

Lithographic type silver halide photographic light-sensitive materials applicable to the infectious development may be unable to provide satisfactory high-contrast images unless they are treated with an infectious developer that is a lith-type developer. For example, in the case that they are developed with an MQ or PQ developer, the resulting gamma value may reach only 5 to 6 at the utmost and there produces many fringes of dots which have to be eliminated at all to form half-tone dots. It has, therefore, been considered that an infectious developer having lower preservability is to be inevitably used in combination.

In this connection, there have been the research and development of the techniques with the aim of forming superhigh contrast images, such as obtained by the infections developer, by the use of a developer having a high sulfite ion concentration and an excellent preservability and capable of performing a rapid treatment. One of the known examples thereof is a technique disclosed in Japanese Patent Publication Open to Public Inspection (hereinafter referred to as Japanese Patent O.P.I. Publication) No. 56-106244/1981. In this technique, a specific compound, that is so-called a contrast increasing agent is made present in a silver halide photographic light-sensitive material, hereinafter referred to as light-sensitive material, and specific silver halide grains and other photographic additives are used in combination so as to satisfactorily display the contrast increasing characteristics of the compound.

This type of silver halide photographic light-sensitive materials may be able to provide superhigh contrast photographic images when treating them with a developer having an excellent preservability and capable of performing a rapid treatment. However, the light-sensitive materials produce a sand-like fogged dots so-called black dots in half-tone images in the course of forming a half-tone image, so that the half-tone image quality is deteriorated. To solve this problem, the attempts of solving the problem have been tried by adding a variety of stabilizers and inhibitors each having hetero atoms. However, it has not been said that the problem could be solved thereby.

SUMMARY OF THE INVENTION

It is an object of the invention to provide a lightsensitive material in which high contrast photographic chracteristics can be obtained without lowering its sensitivity and, at the same time, black dots can be inhibited from producing in a half-tone image so that the high contrast photographic characteristics can be obtained.

The foregoing object of the invention can be achieved with a silver halide photographic light-sensitive material comprising a support bearing thereon at least one silver halide emulsion layer wherein the emulsion layer or a layer adjacent thereto contains at a compound represented by the following Formula 1, 2, or 3 and a compound represented by the following Formula 4 or 5.

Formula 1

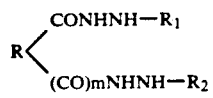

wherein $R_1$ and $R_2$ represent each an aryl or heterocyclic group, R represents a simple linking bond or a divalent organic group, m is 0 or 1, Formula 2

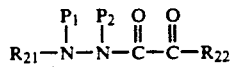

wherein $R_{21}$ represents an aliphatic, aromatic or heterocyclic group, $R_{22}$ represents a hydrogen atom or a substitutable alkoxy, heterocyclicoxy, amino or aryloxy group, and $P_1$ and $P_2$ represent each a hydrogen atom or an acyl or sulfinic acid group.

Formula 3

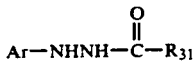

wherein Ar represents a anti-diffusion group or an aryl group containing at least one group which accelarates adsorption to silver halide, and $R_{31}$ represents a substituted alkyl group.

Formula 4

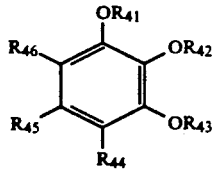

wherein $R_{41}$, $R_{42}$ and $R_{43}$ represent each a hydrogen or halogen atom or an alkyl group having 1 to 23 carbon atoms, and $R_{44}$, $R_{45}$ and $R_{46}$ represent each a hydrogen or halogen atom, an alkyl or alkoxy group each having 1 to 23 carbon atoms, or a carboxyl, carboxylalkyl ester, hydroxyalkyl, hydroxyalkoxyalkyl, sulfo, amidoalkyl, amidophenyl, imidoalkyl or nitrile group.

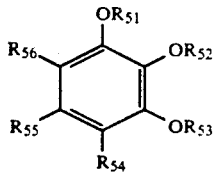

Formula 5 wherein $R_{51}$ and $R_{52}$ represent each a hydrogen or halogen atom or an alkyl group having 1 to 23 carbon atoms, and $R_{53}$, $R_{54}$, $R_{55}$ and $R_{56}$ represent each a hydrogen or halogen atom, an alkyl or alkoxy group each having 1 to 23 carbon atoms, or a carboxyl, carboxylalkyl ester, hydroxyalkyl, hydroxyalkoxyalkyl, sulfo, amidoalkyl, amidophenyl, imidoalkyl or nitrile group.

DETAILED DESCRIPTION OF THE INVENTION

The above-given Formulas 1, 2, 3, 4 and 5 will now be detailed below.

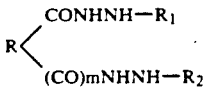

Formula 1 wherein $R_1$ and $R_2$ represent each an aryl or heterocyclic group, R represents a simple linking bond or a divalent organic group, m is 0 or 1.

Also wherein, among the groups each denoted by $R_1$ and $R_2$, the aryl groups include, for example, a phenyl group and a naphthyl group, and the heterocyclic groups include, for example, a pyridyl group, a benzothiazolyl group, a quinolyl group and a thienyl group. Among them, aryl groups are preferable. Various substituents may be introduced into the aryl or heterocyclic groups denoted by $R_1$ and $R_2$. The substituents include, for example, halogen atoms such as those of chlorine and fluorine, alkyl groups such as a methyl, ethyl or dodecyl group, alkoxy groups such as a methoxy, ethoxy, isopropoxy, butoxy, octyloxy or dodecyloxy group, acylamino groups such as an acetylamino, pivalylamino, benzoylamino, tetradecanoylamino or α-(2,4-di-t-amylphenoxy)butylylamino group, sulfonylamino groups such as a methanesulfonylamino, butanesulfonylamino, dodecanesulfonylamino or benzenesulfonylamino group, urea groups such as a phenylurea or ethylurea group, thiourea groups such as a phenylthiourea or ethylthiourea group, a hydroxy group, an amino group, alkylamino groups such as a methylamino or dimethylamino group, a carboxy group, alkoxycarbonyl groups such as an ethoxycarbonyl group, a carbamoyl group, and a sulfo group. The divalent organic groups each denoted by R include, for example, alkylene groups such as a methylene, ethylene, trimethylene or tetramethylene group, arylene groups such as a phenylene or naphthylene group, and an an aralkylene group. The aralkylene group may contain an oxy, thio, seleno, carbonyl,

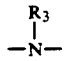

in which $R_3$ represents a hydrogen atom or an alkyl or aryl group, or a sulfonyl group. The groups each denoted by R may be introduced with various substituents thereinto.

The substituents include, for example, —CONHNH$R_4$ in which $R_4$ is synonymous with the foregoing $R_1$ and $R_2$, an alkyl or alkoxy group, a halogen atom, and a hydroxy, carboxy, acyl or aryl group.

The alkylene groups are preferable among the groups denoted by R.

Among the compounds represented by Formula 1, the preferable compounds include those in which $R_1$ and $R_2$ represent each a substituted or unsubstituted phenyl group, n=m=1, and R represents an alkylene group.

The typical compounds represented by the foregoing Formula 1 given below.

Exemplified compounds 1-1

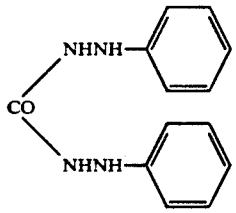

1-2

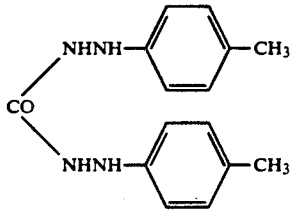

-continued
Exemplified compounds
1-3
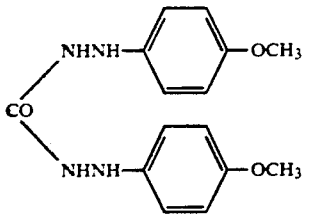
1-4
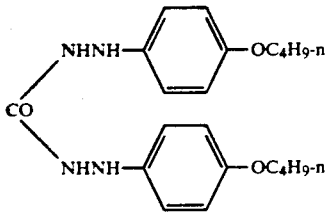
1-5
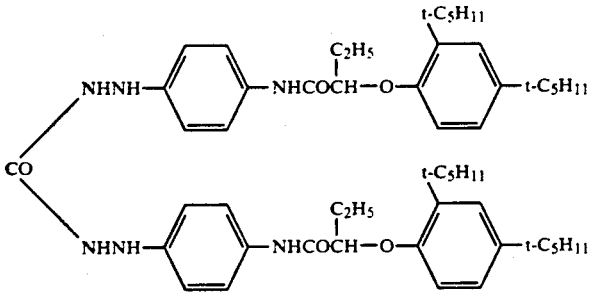
1-6
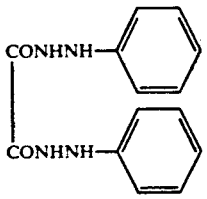
1-7
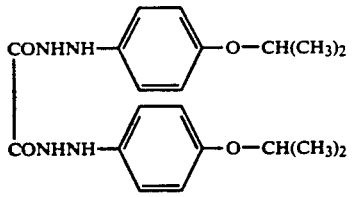
1-8
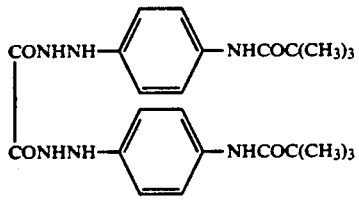

-continued
Exemplified compounds
1-9
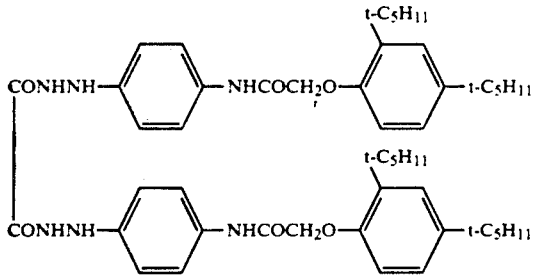
1-10
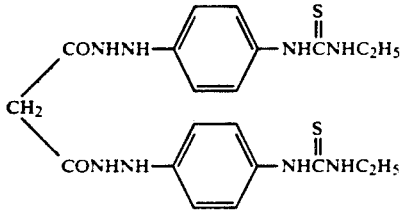
1-11
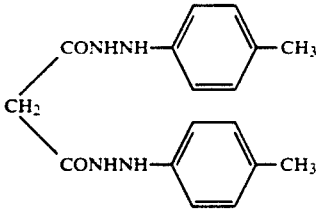
1-12
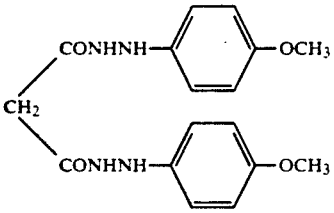
1-13
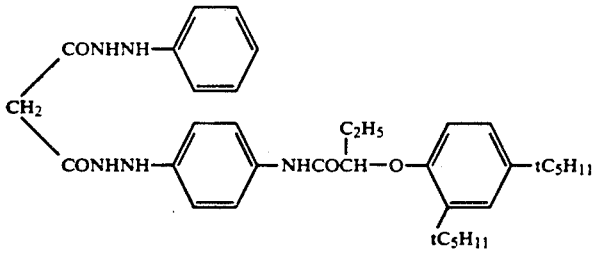
1-14
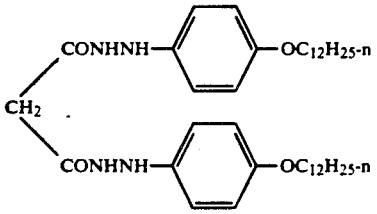

-continued
Exemplified compounds
1-15
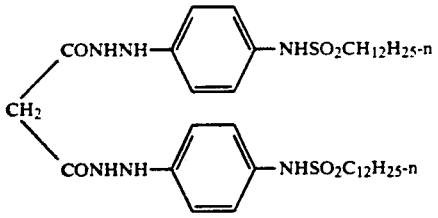
1-16
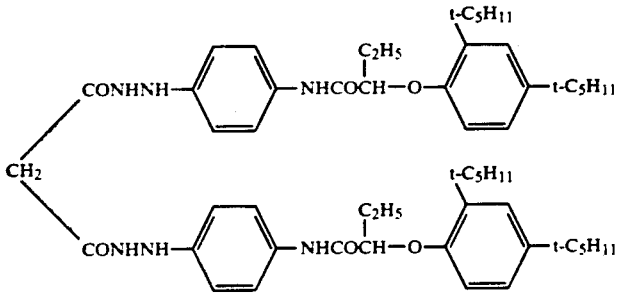
1-17
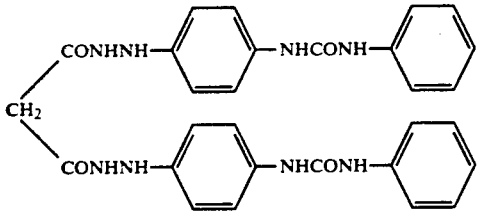
1-18
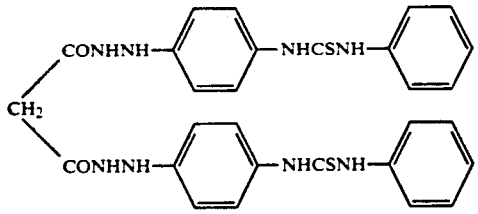
1-19
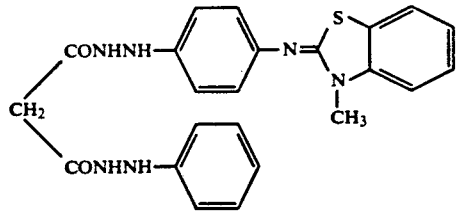
1-20
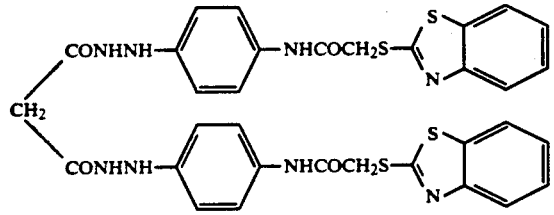

-continued
Exemplified compounds
1-21
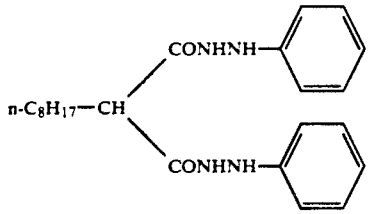
1-22
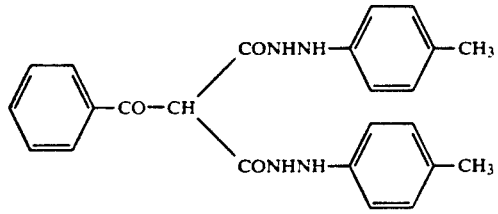
1-23
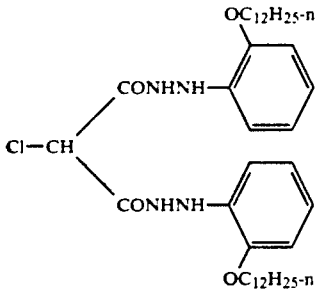
1-24
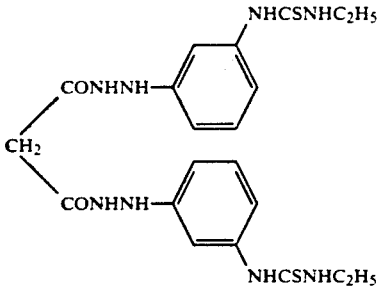
1-25
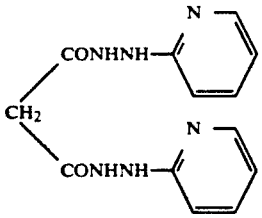
1-26
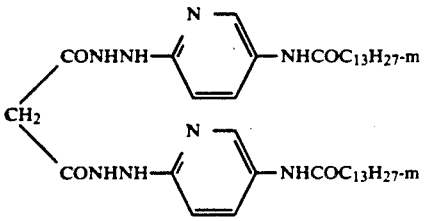

-continued
Exemplified compounds
1-27
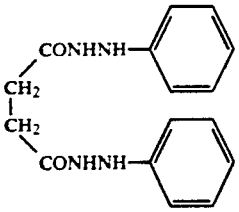
1-28
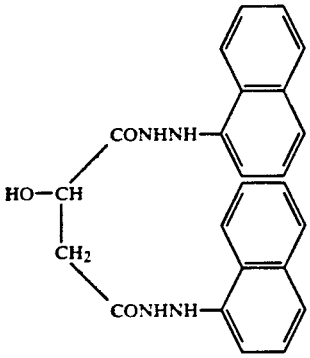
1-29
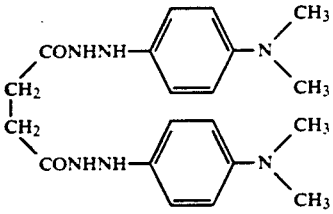
1-30
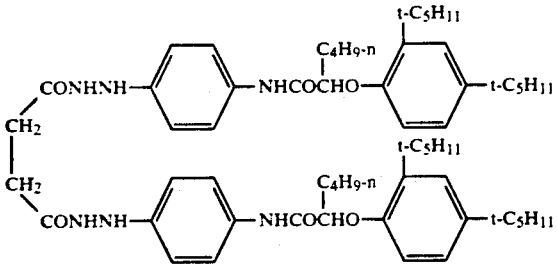
1-31
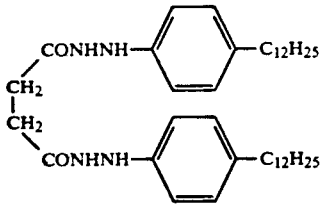
1-32
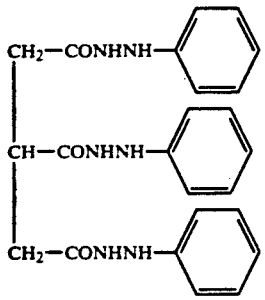

-continued
Exemplified compounds
1-33
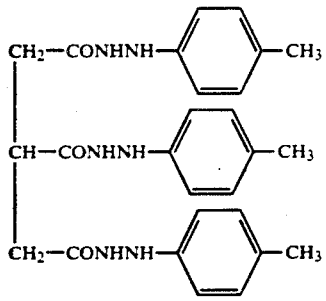
1-34
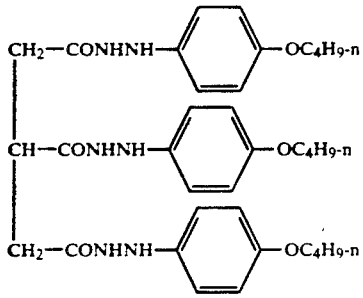
1-35
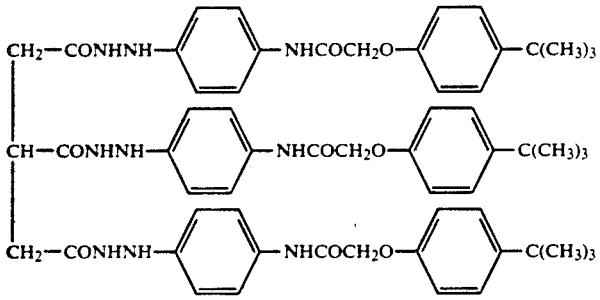
1-36
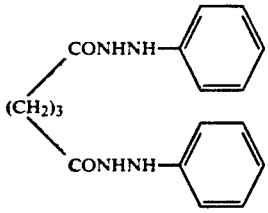
1-37
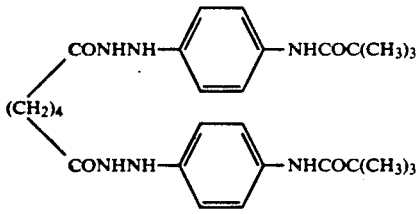
1-38
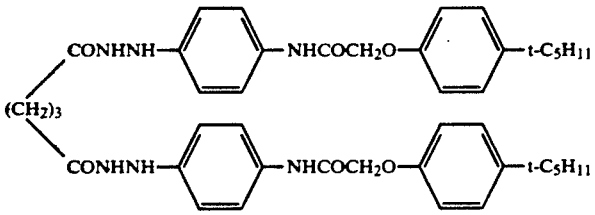

-continued
Exemplified compounds
1-39
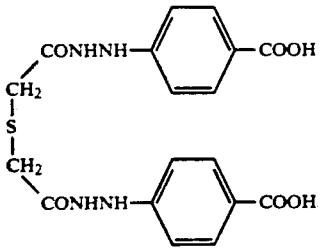
1-40
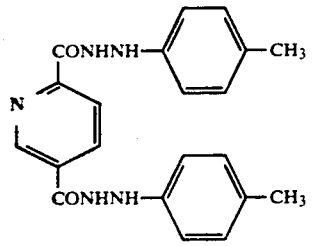
1-41
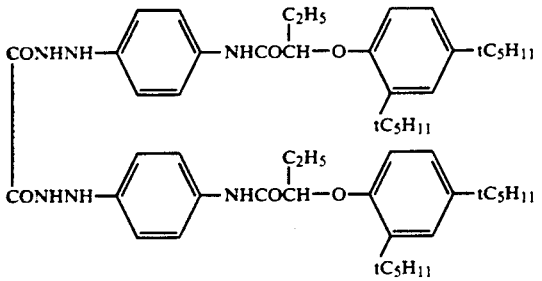
1-42
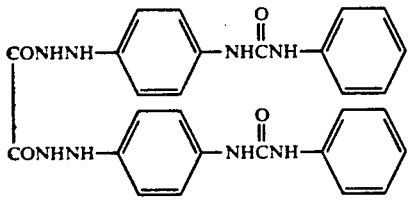
1-43
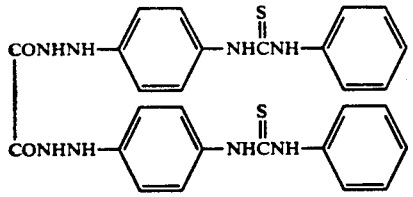
1-45
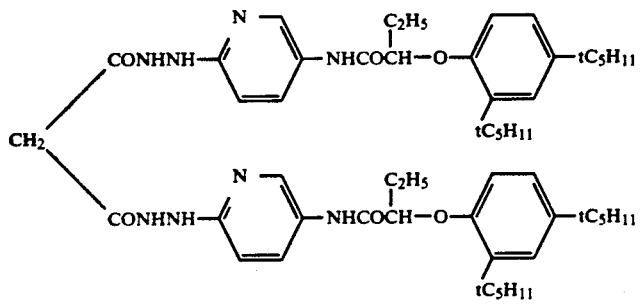

-continued
Exemplified compounds
1-46
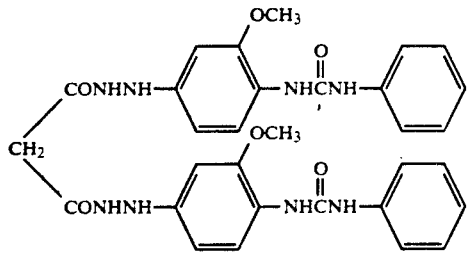
1-47
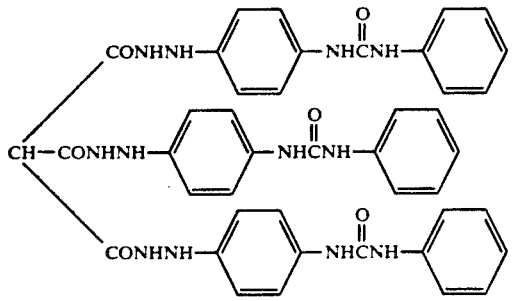
1-48
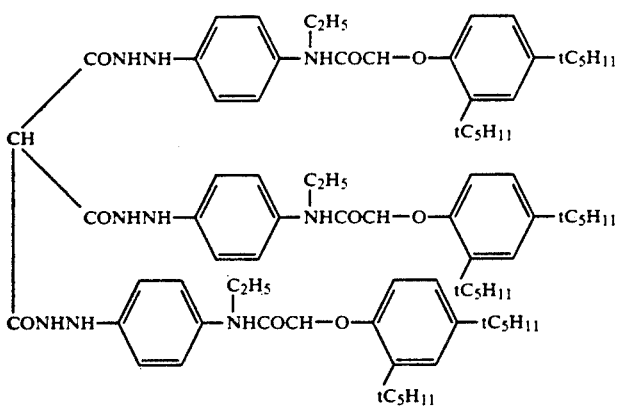
1-49
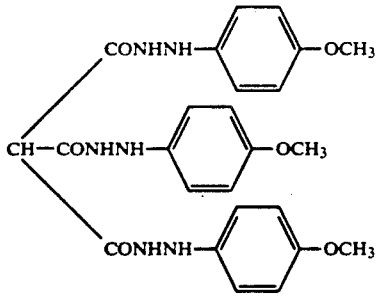
1-50
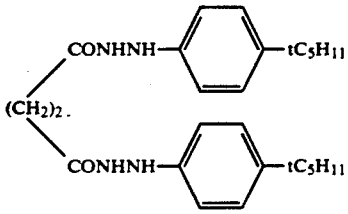

-continued

Exemplified compounds 1-51

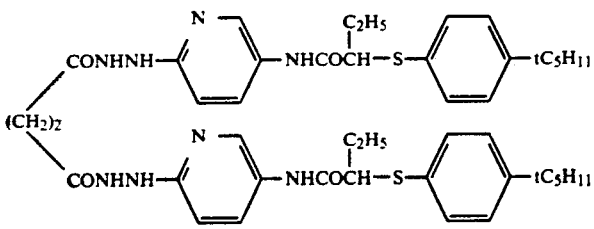

1-52

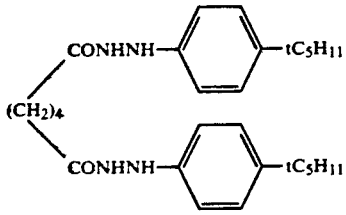

1-53

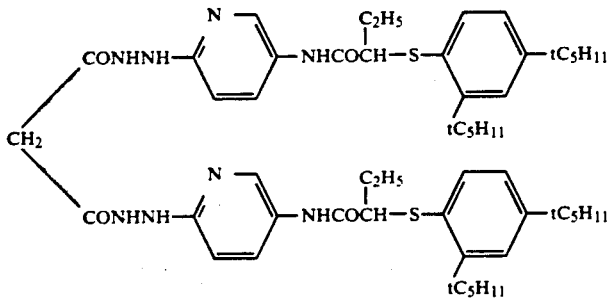

1-54

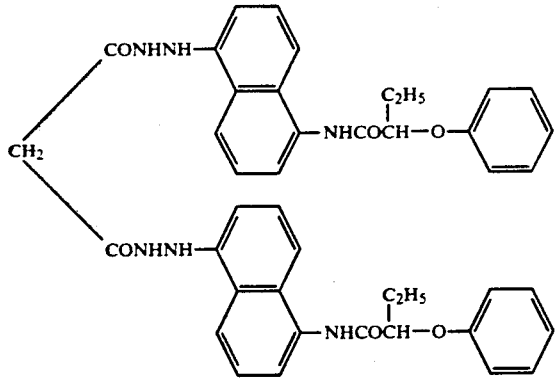

1-55

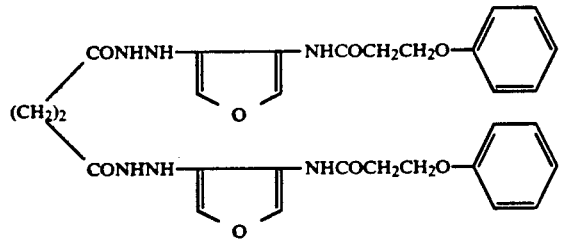

Next, Formula 2 will now be detailed below.

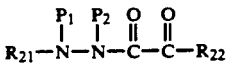

wherein the aliphatic groups represented by $R_{21}$ include, preferably those having each not less than 6 carbon atoms and, particularly straight- or branch-chained or cyclo alkyl groups having each 8 to 50 carbon atoms. In this case, the branch-chained alkyl groups may be so made cyclic as to form a saturated hetero ring containing 1 or more hetero atoms therein. These alkyl groups each may also have a substituent such as an aryl, alkoxy or sulfoxy group.

The aromatic groups each represented by $R_{21}$ are a monoor bi- cycloaryl group or an unsaturated heterocyclic group. The unsaturated heterocyclic groups are each allowed to form a heteroaryl group upon condensation with a mono- or bicycloaryl group.

They include, for example, a benzene ring, a naphthalene ring, a pyridine ring, a pyrimidine ring, an imidazole ring, a pyrrolazole ring, a quinoline ring, an isoquinoline ring, a benzimidazole ring, a thiazole ring, and a benzothiazole ring. Those containing a benzene ring therein are preferable among them.

Among those represented by $R_{21}$, aryl groups are particularly preferable.

The aryl or unsaturated heterocyclic groups each represented by $R_{21}$ may be substituted with a substituent. The typical substituents include, for example, straight- or branch-chained alkyl groups or cycloalkyl groups including preferably a mono- or bi- cycloalkyl group having 1 to 20 carbon atoms in the alkyl component thereof, alkoxy groups including preferably those having each 1 to 20 carbon atoms, substituted amino groups including preferably amino groups substituted with an alkyl group having 1 to 20 carbon atoms, acylamino groups including preferably those having each 2 to 30 carbon atoms, sulfonamido groups including preferably those having each 1 to 30 carbon atoms, and ureido groups including preferably those having each 1 to 30 carbon atoms.

Among the groups represented by $R_{22}$ denoted in Formula 2, the substitutable alkoxy groups include, for example, those having each 1 to 20 carbon atoms, and they may be substituted with a halogen atom or an aryl group.

Among the groups represented by $R_{22}$ in Formula 2, the substitutable and monocyclic aryloxy or heterocyclic-oxy groups are preferable. The substituents thereto include, for example, a halogen atom or an alkyl, alkoxy or cyano group.

The preferable groups among the groups represented by $R_{22}$ include, for example, substitutable alkoxy or amino groups.

In the case of an amino group, it is a

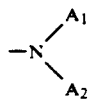

group in which $A_1$ and $A_2$ each are a substitutable alkyl or alkoxy group or a cyclic group containing a linkage to an —O—, —S— or —N—group, provided, $R_{22}$ does not represent any hydrazino group.

The groups represented by $R_{21}$ or $R_{22}$ denoted in Formula 2 may be incorporated thereinto with an anti-diffusion or a ballast group which is popularly used in immobile photographic additives such as couplers. The ballast groups are those relatively inert in any photographic reaction, each of which has not less than 8 carbon atoms. The ballast groups may be selected from, for example, alkyl, alkoxy, phenyl, alkylphenyl, phenoxy and alkylphenoxy groups.

The groups represented by $R_{21}$ or $R_{22}$ denoted in Formula 2 may also be incorporated thereinto with a group capable of enhancing an adsorption of silver halide grain surfaces. The adsorbing groups include the groups described in U.S. Pat. No. 4,355,105, such as a thiourea, heterocyclic thioamido, heterocyclic mercapto or triazole group.

Among the compound represented by Formula 2, the compounds represented by the Formula 2-a given below are particularly preferable.

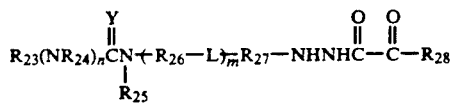

Formula 2-a wherein $R_{23}$ and $R_{24}$ represent each a hydrogen atom, substitutable alkyl groups such as a methyl, ethyl, butyl, dodecyl, 2-hydroxypropyl, 2-cyanoethyl or 2-chloroethyl group, substitutable phenyl groups, naphthyl groups, cyclohexyl groups, pyridyl groups, and pyrrolidyl groups such as a phenyl, p-methylphenyl, naphthyl, α-hydroxynaphthyl, cyclohexyl, p-methylcyclohexyl, pyridyl, 4-propyl-2-pyridyl, pyrrolidyl, or 4-methyl-2-pyrrolidyl group.

$R_{25}$ represents a hydrogen atom, a substitutable benzyl, alkoxy, or alkyl group such as a benzyl, p-methylbenzyl, methoxy, ethoxy, ethyl or butyl group.

$R_{26}$ and $R_{27}$ represent each divalent aromatic groups such as a phenylene or naphthylene group, Y represents a sufur or oxygen atom, and L represents divalent linking groups such as $—SO_2CH_2CH_2NH—SO_2NH—$, $—OCH_2SO_2NH—$, —O— or —CH=N—.

$R_{28}$ represents —NR'R" or $—OR_{29}$.

R', R" and $R_{29}$ represent each a hydrogen atom, a substitutable alkyl group such as a methyl, ethyl or dodecyl group, a phenyl group such as a phenyl, p-methylphenyl or p-methoxyphenyl group, a naphthyl group such as an α-naphthyl or β-naphthyl group, or a heterocyclic group including, for example, unsaturated heterocyclic groups such as pyridine, thiophene and furan or saturated heterocyclic groups such as tetrahydrofuran and sulfolane.

Together with a nitrogen atom, R' and R"R are allowed to form a ring such as those of piperidine, piperazine or morpholine.

m and n are each an integer of 0 or 1. When $R_{26}$ represents $OR_{29}$, Y is preferable to represent a sulfur atom.

The typical compounds represented by the foregoing Formulas 2 and 2-a will be given below.

Typical examples of Formula 2

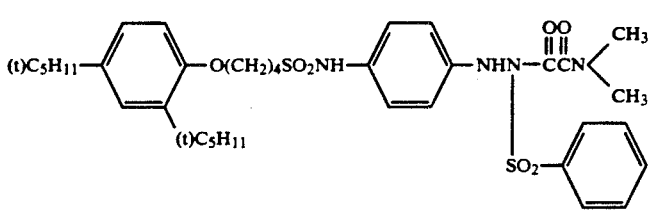

2-1

-continued
Typical examples of Formula 2
2-2
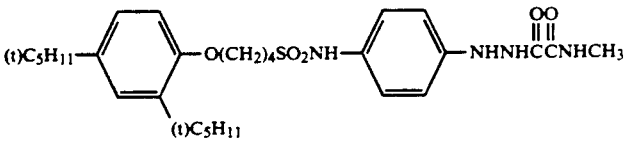
2-3
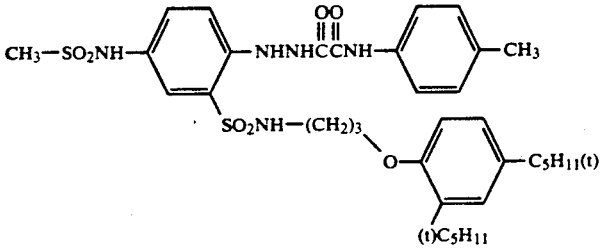
2-4
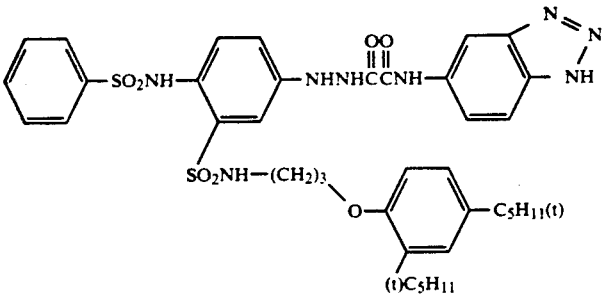
2-5
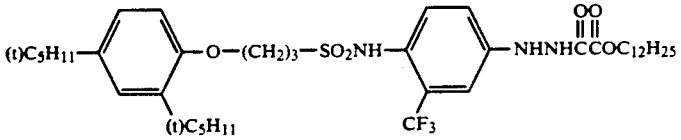
2-6
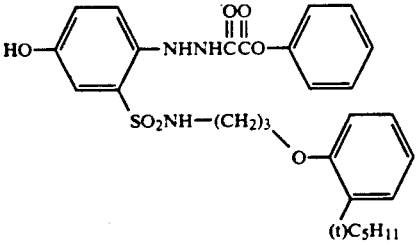
2-7
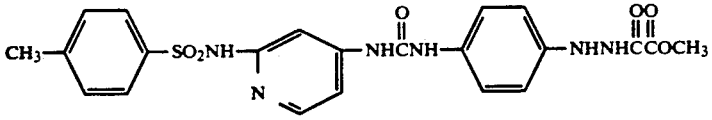
2-8
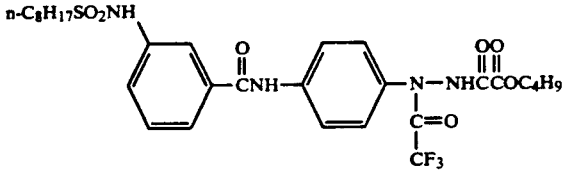
2-9
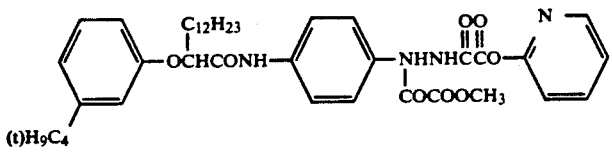

-continued
Typical examples of Formula 2
2-10
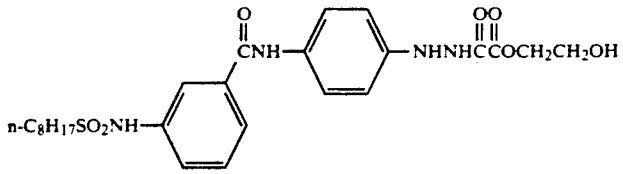
2-11
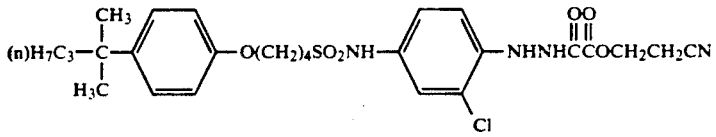
2-12
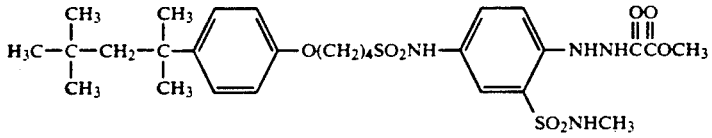
2-13
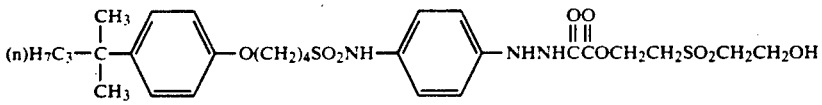
2-14
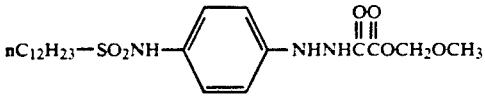
2-15
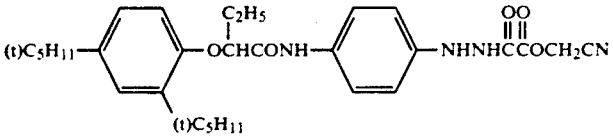
2-16
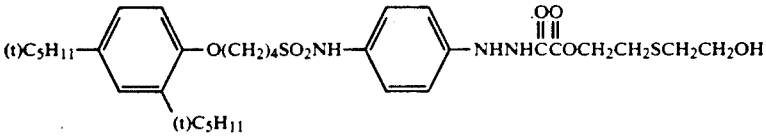
2-17
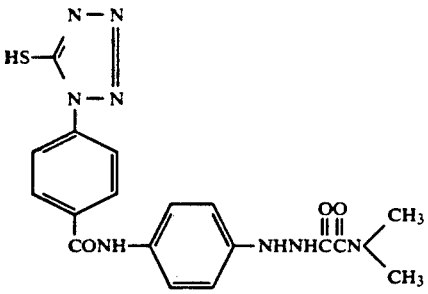
2-18
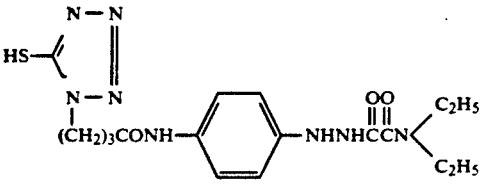

-continued
Typical examples of Formula 2
2-19
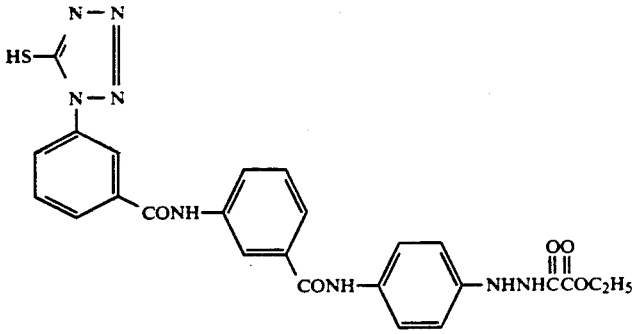
2-20
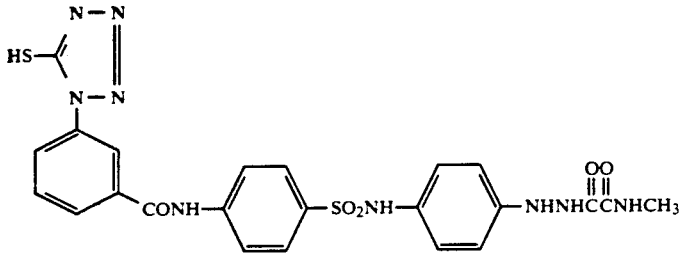
2-21
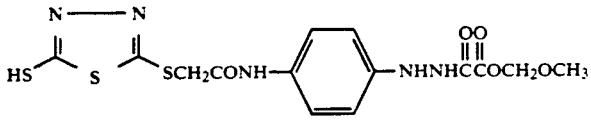
2-22
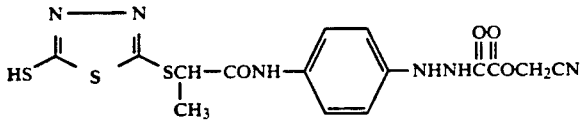
2-23
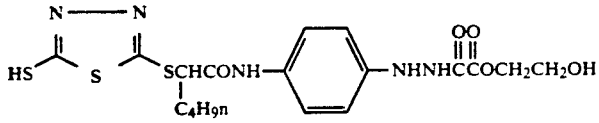
2-24
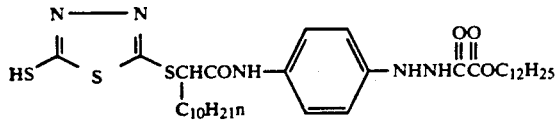
2-25
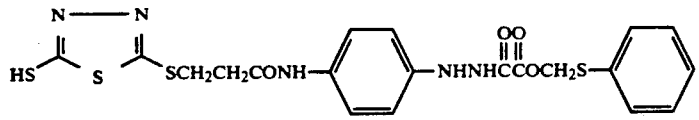
2-26
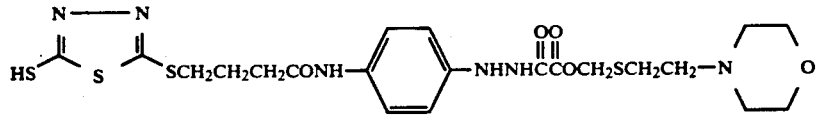
2-27
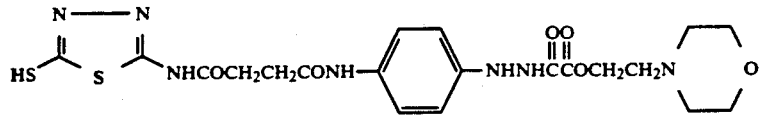

-continued
Typical examples of Formula 2
2-28
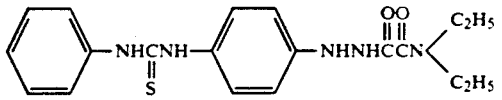
2-29
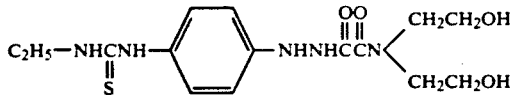
2-30
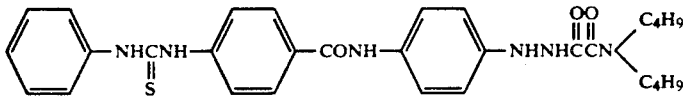
2-31
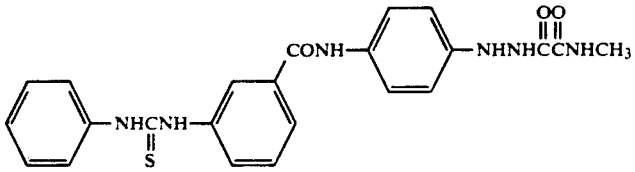
2-32
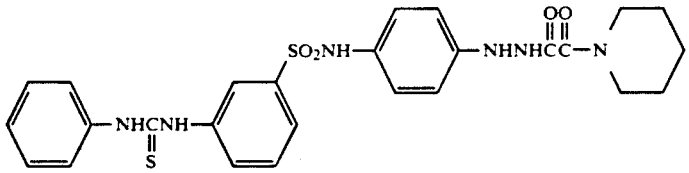
2-33
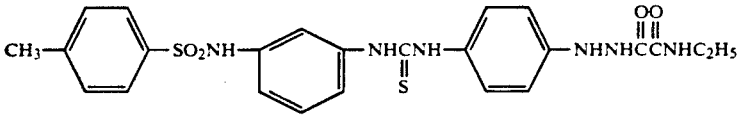
2-34
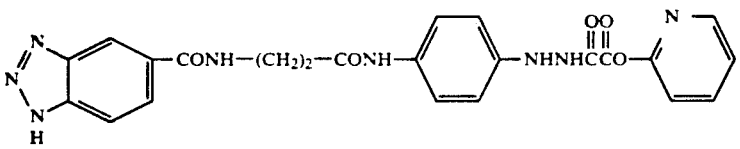
2-35
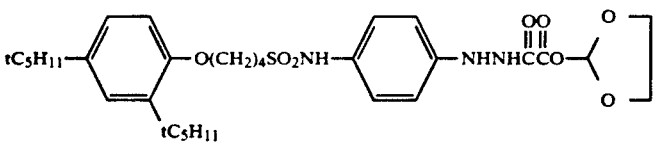
2-36
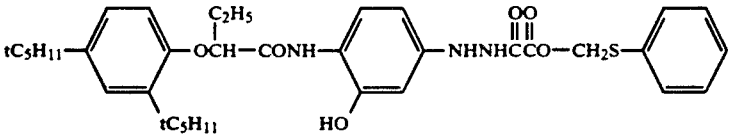
2-37
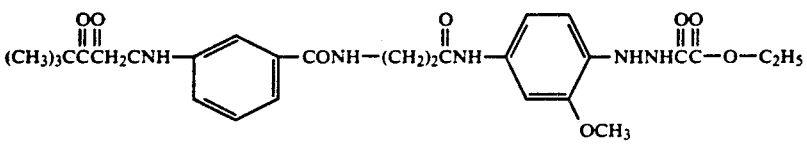

-continued
Typical examples of Formula 2
2-38
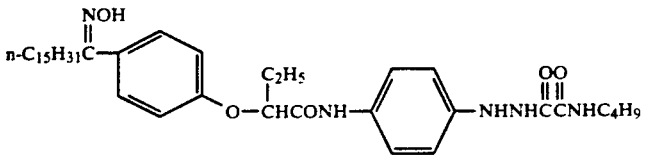
2-39
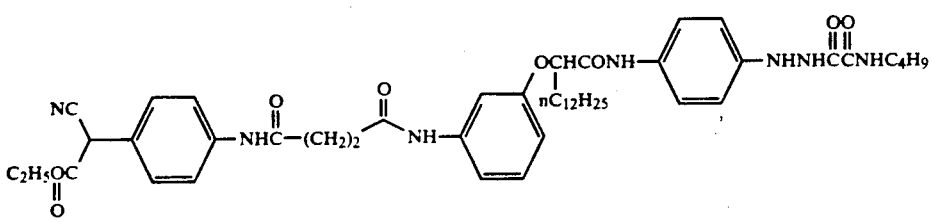
2-40
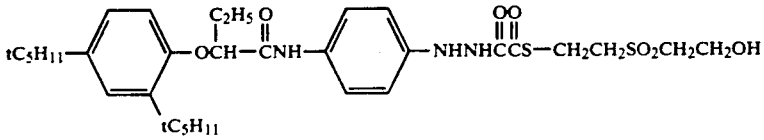
2-41
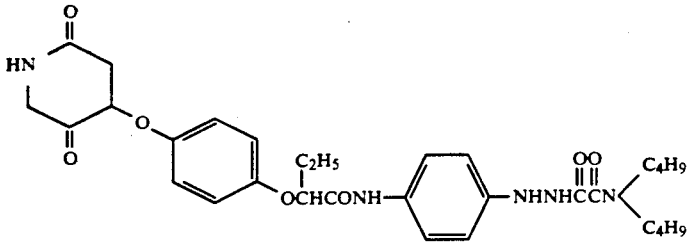
2-42
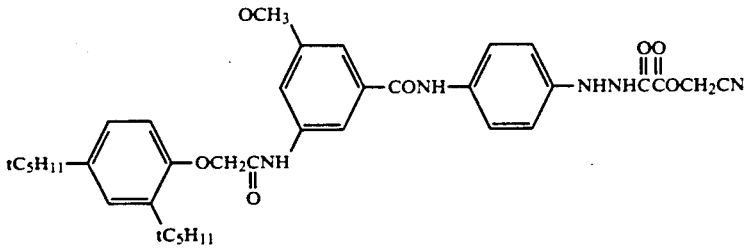
2-43
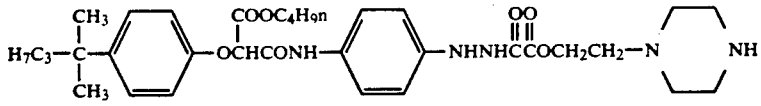
2-44
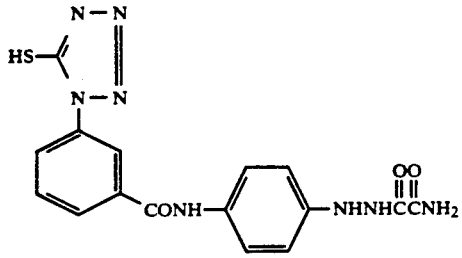
2-45
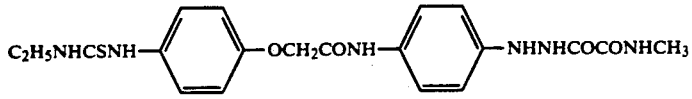

-continued
Typical examples of Formula 2
2-46
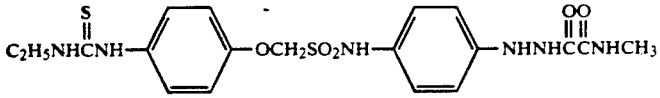
2-47
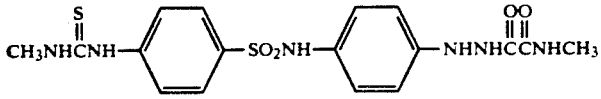
2-48
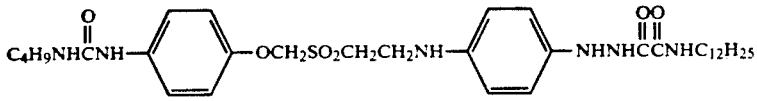
2-49
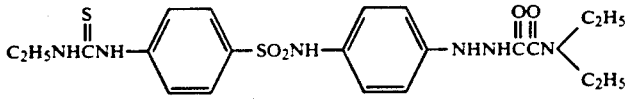
2-50
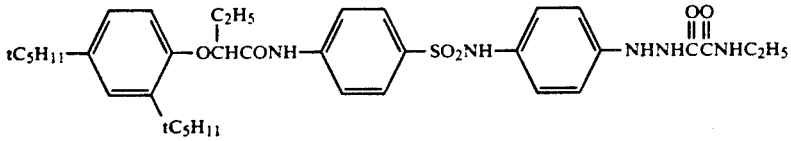
2-51
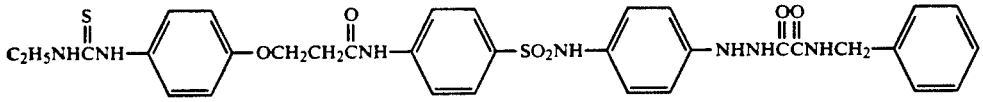
2-52
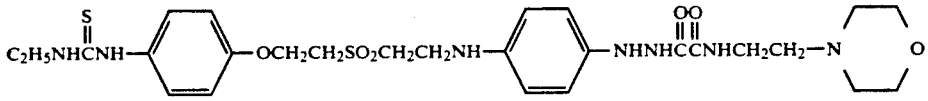
2-53
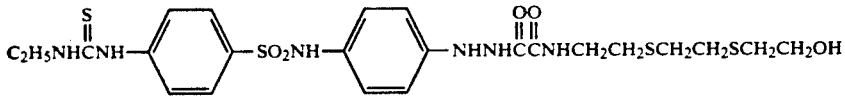
2-54
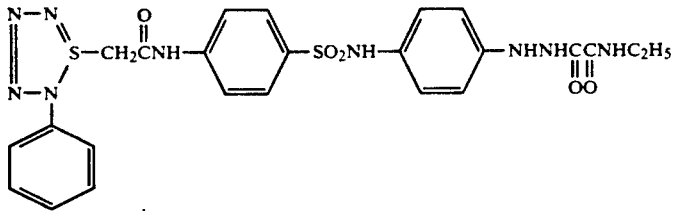
2-55
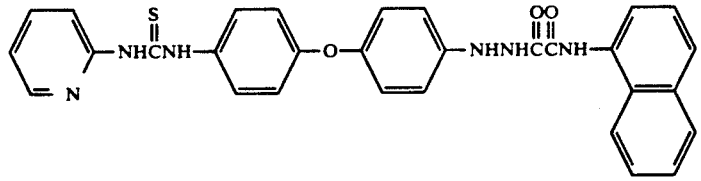
2-56
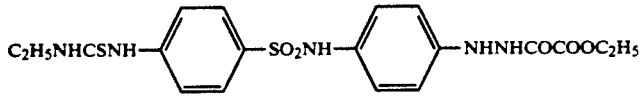

-continued
Typical examples of Formula 2
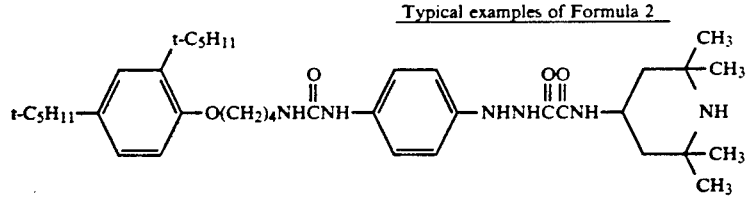
2-57
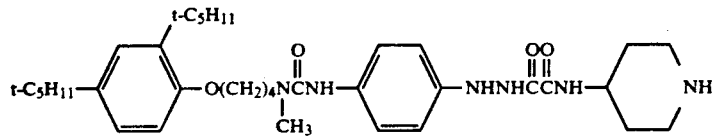
2-58
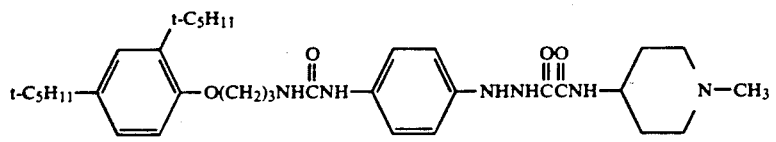
2-59
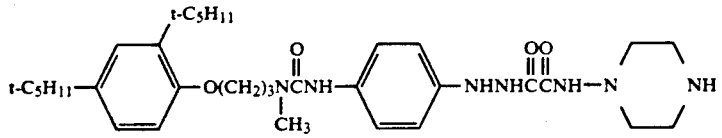
2-60
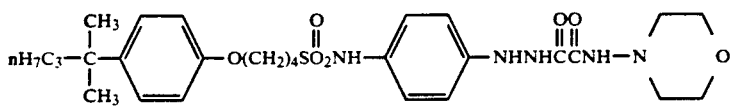
2-61
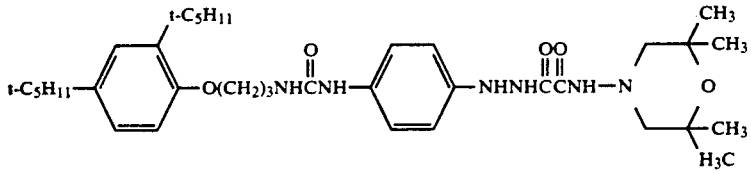
2-62
Next, refering to Compounds Nos. 2-45 and 2-47 selected from the above-given typical examples, the synthesizing process thereof will be detailed below.
Synthesis of Compound No. 2-45
Synthesizing scheme
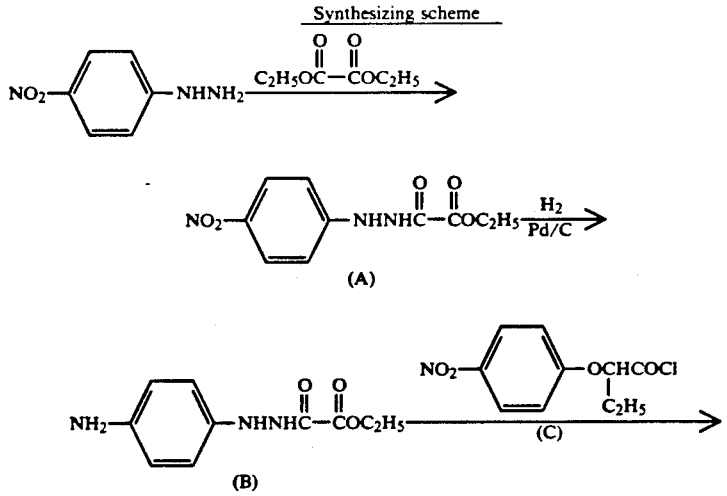

-continued

Synthesizing scheme

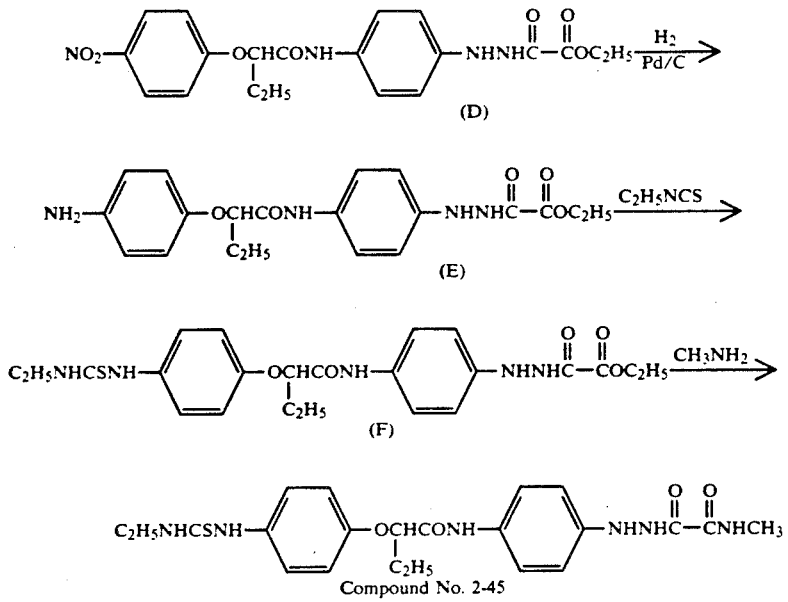

4-nitrophenylhydrazine of 153 g and diethyloxalate of 500 ml are mixed up to9ether and the mixture is refluxed for one hour. While keeping the reflux reaction on, ethanol is removed and, lastly, the mixture is cooled down and crystals are deposited. After filtrating the crystals, they are washed several times with petroleum ether and are then recrystallized to obtain crystals A. Out of the resulting crystals A, 50 g of them are dissolved in 1000 ml of methanol with heating and are then reduced in the presence of pd/C, i.e., palladium and carbon, and in the atmosphere of $H_2$ to which a pressure of 50 Psi is applied, so that Compound B can be obtained.

Compound B of 22 g is dissolved in a solution containing 200 ml of acetonitrile and 16 g of pyridine, and an acetonitrile solution containing 24 g of Compound C is dropped thereinto at room temperature. After filtrating insoluble matter away, the resulting filtrate is condensed and refined by recrystallizing it, so that 31 g of Compound D can be obtained.

In the same manner as in the above, 30 g of Compound D are hydrogenated, so that 20 g of Compound E can be obtained.

Compound E of 10 g are dissolved in 100 ml of acetonitrile and 3.0 g of ethylisothiocyanate are added. The resulting solution is refluxed for one hour. After the solvent is distilled off, the refluxed matter is recrystallized and refined, so that 7.0 g of Compound F can be obtained. Compound F of 5.0 g is dissolved in 50 ml of methanol and 8 ml of 40% aqueous solution of methylamine with stirring. After methanol is condensed to some extent, the deposited solids are taken out and recrystallized to be refined, so that Compound Nos. 2–45 can be obtained.

Synthesis of Compound Nos. 2–47

Synthesis scheme

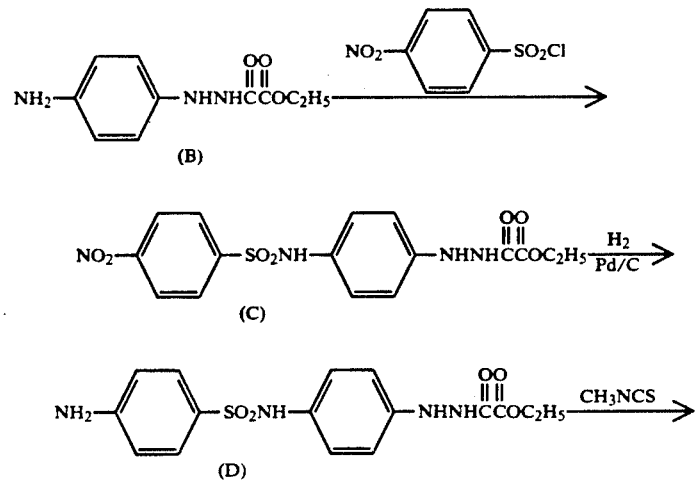

-continued

Synthesis scheme

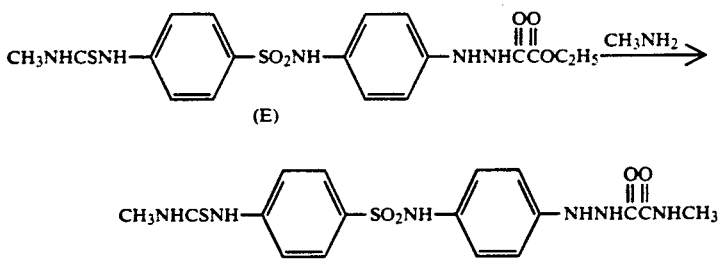

Compound Nos. 2-47

Compound B of 22 g are dissolved in 200 ml of pyridine. While it is being stirred, 22 g of p-nitrobenzenesulfonyl chloride are added thereto. The resulting reacted mixture is poured into water and the deposited solids are then taken out, so that Compound C can be obtained. According to the synthesis scheme, Compound C is reacted in the same manner as in the case of Compound Nos. 2–45, so that Compound Nos. 2–47 can be obtained.

Next, Formula 3 will now be detailed below.

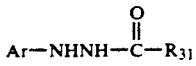

Formula 3

Wherein Ar represents an aryl group containing at least one anti-diffusion group or a group which accelerates adsorption of the compound to silver halide. As for the anti-diffusion group or the ballast groups, it is preferable to use ballast groups which are popularly used in immobile photographic additives such as couplers. The ballast groups are those relatively inert in photographic reactions, each of which has not less than 8 carbon atoms. For example, they may be selected from the group of alkyl, alkoxy, phenyl, alkylphenyl, phenoxy and alkylphenoxy groups.

The silver halide adsorption accelerating groups include, for example, those described in U.S. Pat. No. 4,385,108, such as a thioureido, thiourethano, heterocyclic thioamido, heterocyclic mercapto or triazole group.

$R_{31}$ represents a substituted alkyl group. The alkyl groups are straight- or branch-chained or cyclic alkyl groups including, for example, a methyl, ethyl, propyl, butyl, isopropyl, pentyl or cyclohexyl group.

The substituents introduced into the above-given alkyl groups include, for example, the following groups:

Alkoxy groups such as a methoxy or ethoxy group, aryloxy groups such as a phenoxy or p-chlorophenoxy group, heterocyclic-oxy groups such as a pyridyloxy group, mercapto groups, alkylthio groups such as a methylthio or ethylthio group, arylthio groups such as a phenylthio or p-chlorophenylthio group, heterocyclic thio groups such as a pyridylthio, pyrimidylthio or thiadiazolylthio group, alkylsulfonyl groups such as a methanesulfonyl or butanesulfonyl group, arylsulfonyl groups such as a benzenesulfonyl group, heterocyclic sulfonyl groups such as a pyridylsulfonyl or morpholinosulfonyl group, acyl groups such as an acetyl or benzoyl group, cyano groups, chlorine atom, bromine atom, alkoxycarbonyl groups such as an ethoxycarbonyl or methoxycarbonyl group, aryloxycarbonyl groups such as a phenoxycarbonyl group, carboxy groups, carbamoyl groups, alkylcarbamoyl groups such as an N-methylcarbamoyl or N,N-dimethylcarbamoyl group, arylcarbamoyl groups such as an N-phenylcarbamoyl group, amino groups, alkylamino groups such as a methylamino or N,N-dimethylamino group, arylamino groups such as a phenylamino or naphthylamino group, acylamino groups such as an acetylamino or benzoylamino group, alkoxycarbonylamino groups such as an ethoxycarbonylamino group, aryloxycarbonylamino groups such as a phenoxycarbonylamino group, acyloxy groups such as an acetyloxy or benzoyloxy group, alkylaminocarbonyloxy groups such as a methylaminocarbonyloxy group, arylaminocarbonyloxy groups such as a phenylaminocarbonyloxy group, sulfo groups, sulfamoyl groups, alkylsulfamoyl groups such as a methylsulfamoyl group, and arylsulfamoyl groups such as a phenylsulfamoyl group.

The hydrogen atom of hydrazine may be substituted with a substituent such as sulfonyl groups such as a methanesulfonyl or toluenesulfonyl group, acyl groups such as an acetyl or trifluoroacetyl group, or oxalyl groups such as an ethoxalyl group.

The typical compounds represented by the foregoing Formula 3 include the following compounds:

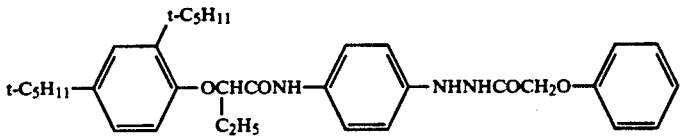

3-1

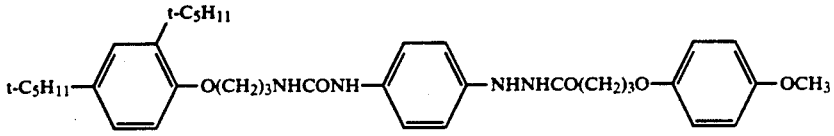

3-2

-continued
3-3
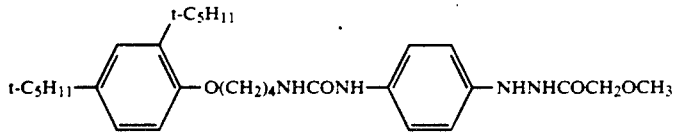
3-4
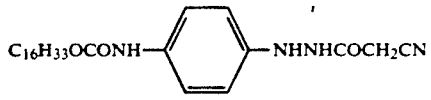
3-5
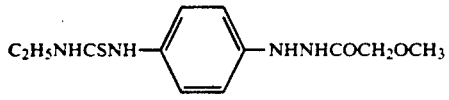
3-6
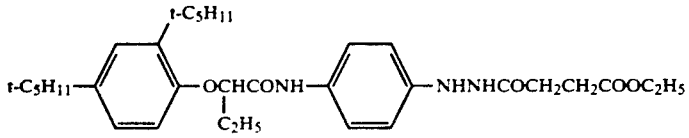
3-7
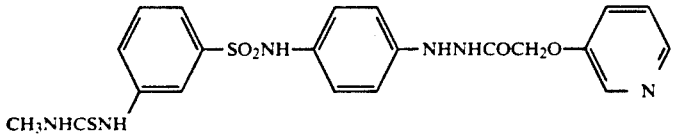
3-8
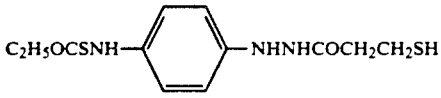
3-9
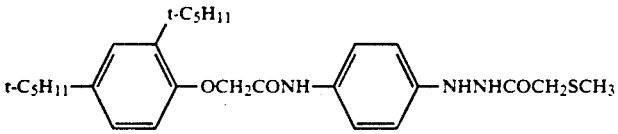
3-10
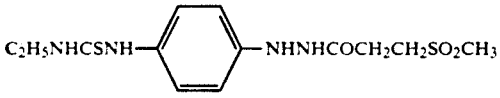
3-11
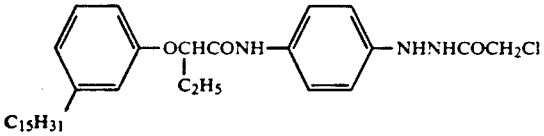
3-12
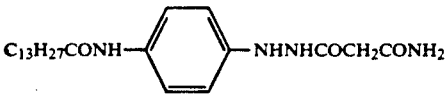
3-13
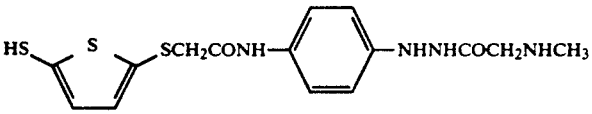
3-14
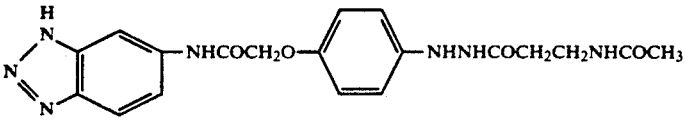

-continued
3-15
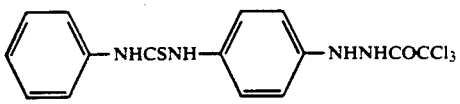
3-16
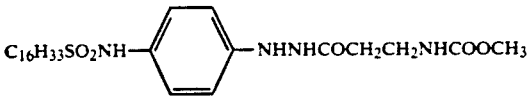
3-17
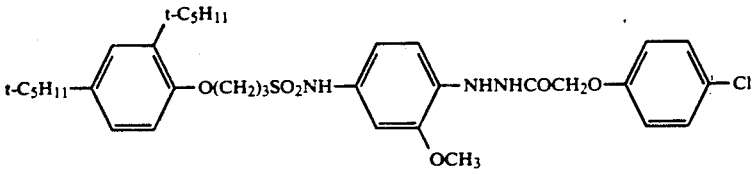
3-18
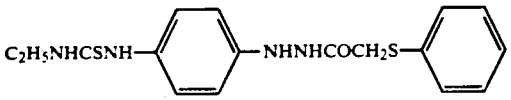
3-19
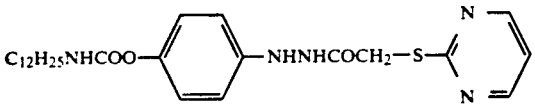
3-20
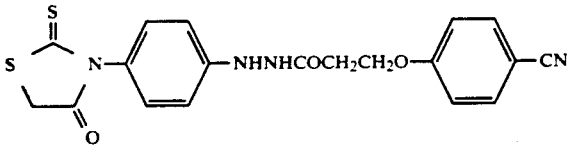
3-21
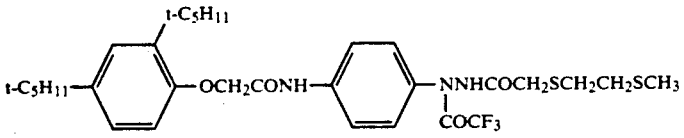
3-22
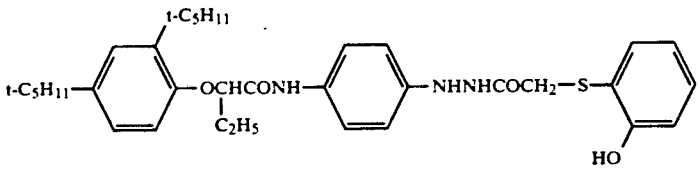
3-23
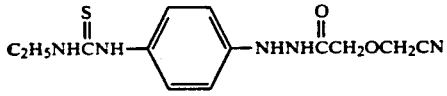
3-24
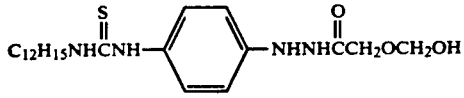
3-25
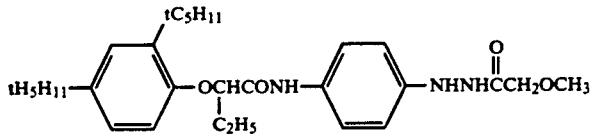
3-26
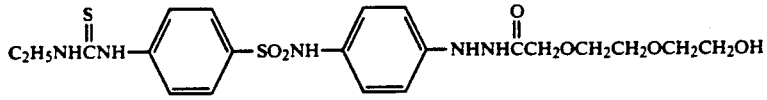

-continued
3-27
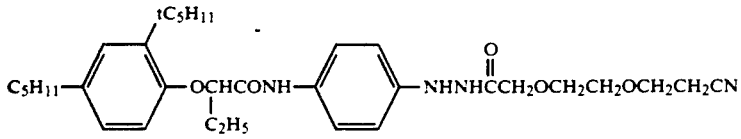
3-28
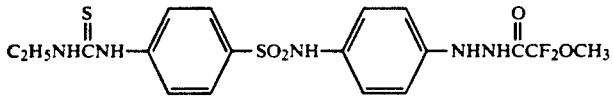
3-29
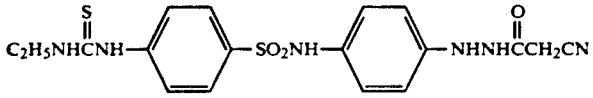
3-30
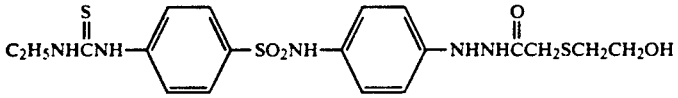
3-31
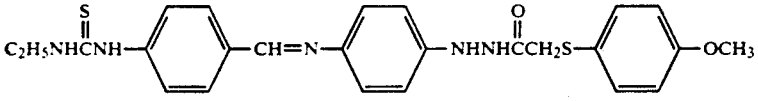
3-32
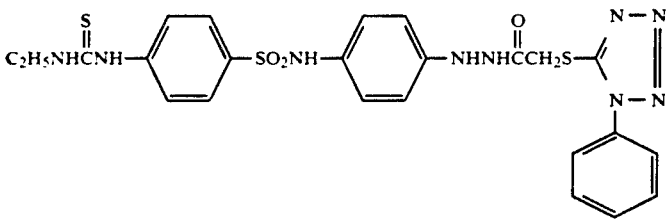
3-33
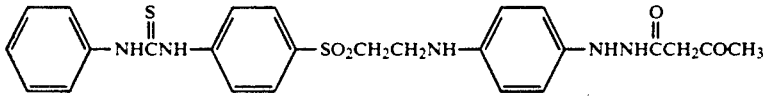
3-34
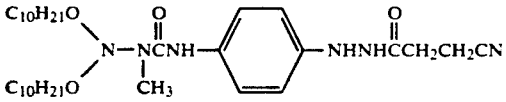
3-35
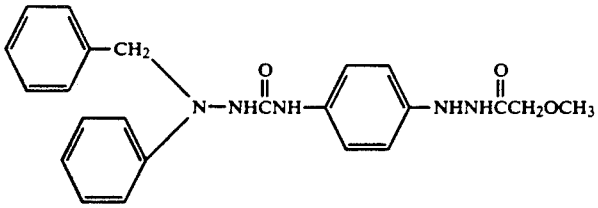
3-36
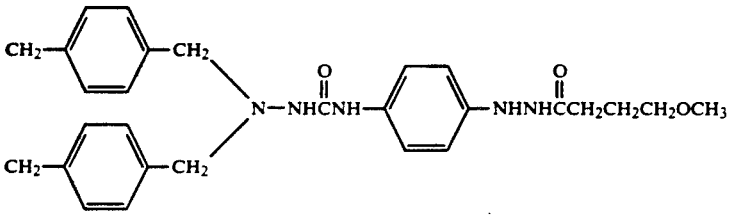

-continued
3-37
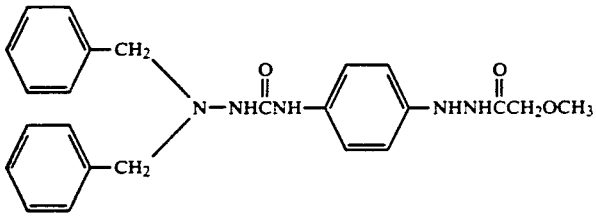
3-38
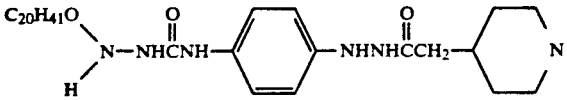
3-39
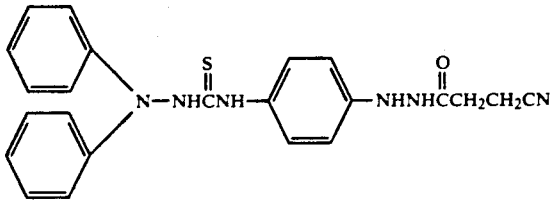
3-40
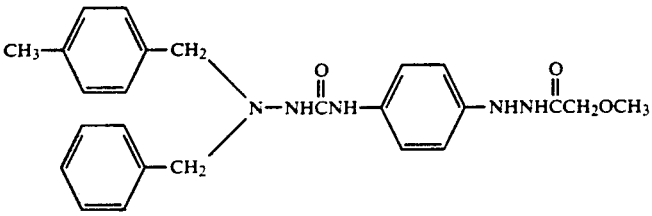
3-41
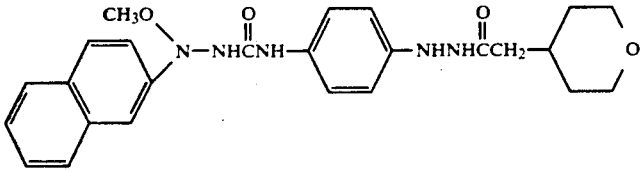
3-42
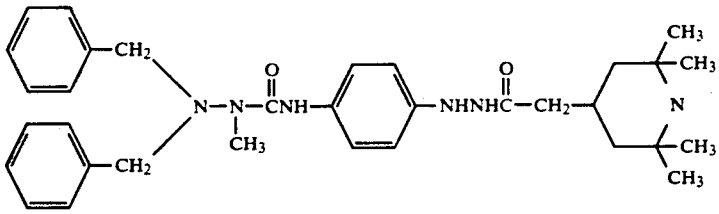
3-43
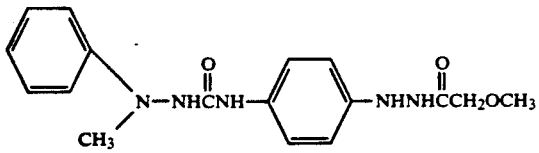
Next, the synthesis examples of Compound Nos. 3-5 will be detailed below.
Synthesis of Compound Nos. 3-5
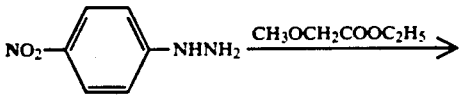
-continued
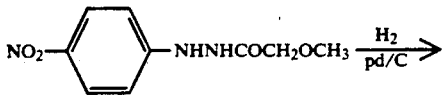
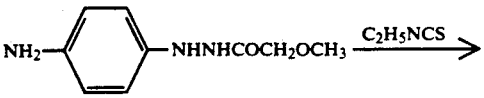

-continued

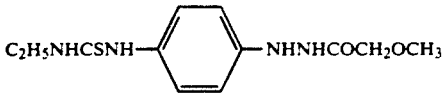

According to the synthesizing process for Compound Nos. 2–45, Compound Nos. 3–5 can be obtained.

In each light-sensitive material of the invention, the contents of the compounds represented by Formulas 1, 2 and 3 are within the range of, preferably, $5\times10^{-7}$ to $5\times10^{-1}$ mols and, more preferably, $5\times10^{-6}$ to $1\times10^{-2}$ mols per mol of the silver halide contained in the light-sensitive material.

Formula 4

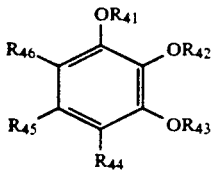

wherein $R_{41}$, $R_{42}$ and $R_{43}$ represent each a hydrogen or halogen atom, or an alkyl group having 1 to 23 carbon atoms, and $R_{44}$, $R_{45}$ and $R_{46}$ represent each a hydrogen or halogen atom, an alkyl or alkoxy group having 1 to 23 carbon atoms, or a carboxy, carboxyalkyl ester, hydroxyalkyl, hydroxyalkoxyalkyl, sulfo, amidoalkyl amidophenyl, imidoalkyl or nitrile group.

The above-given groups each include those having a substituent. For example, a fluorinated alkyl group or an alkali metal substituted sulfo group may be used.

Next, the typical compounds represented by the above Formula 4, which may be used in the invention, will now be exemplified below:

Exemplified compounds 4-1

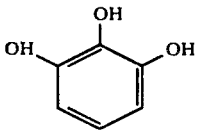

4-2

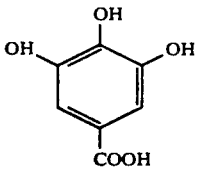

4-3

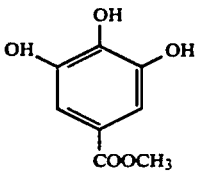

4-4

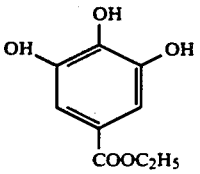

-continued

Exemplified compounds 4-5

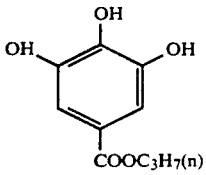

4-6

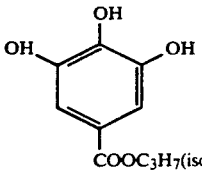

4-7

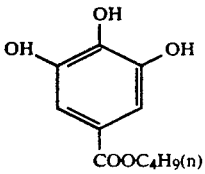

4-8

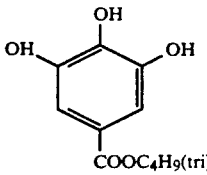

4-9

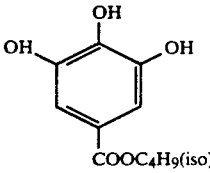

4-10

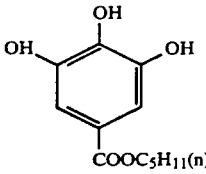

4-11

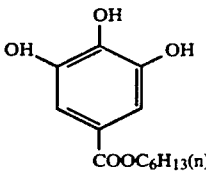

4-12

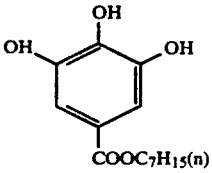

4-13

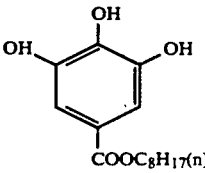

-continued
Exemplified compounds
4-14
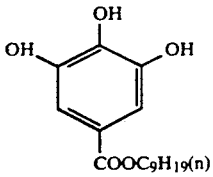
4-15
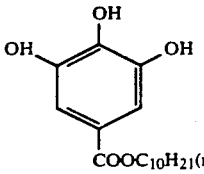
4-16
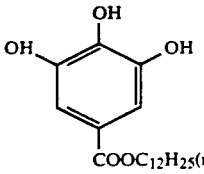
4-17
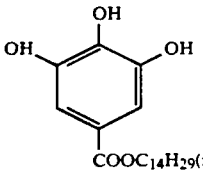
4-18
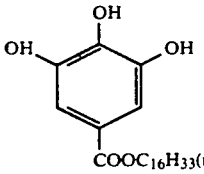
4-19
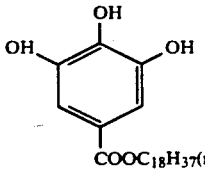
4-20
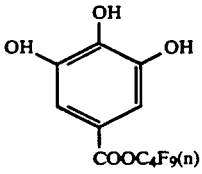
4-21
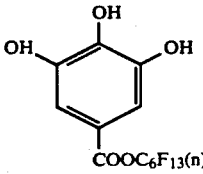
-continued
Exemplified compounds
4-22
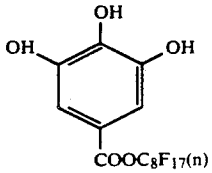
4-23
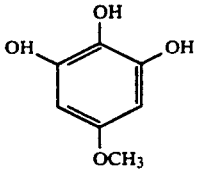
4-24
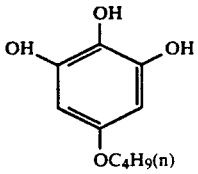
4-25
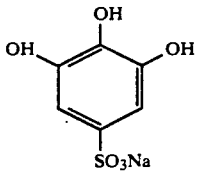
4-26
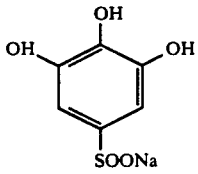
4-27
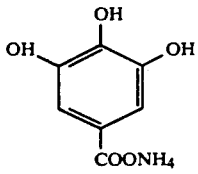
4-28
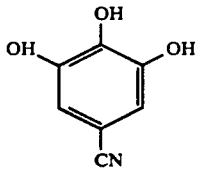
4-29
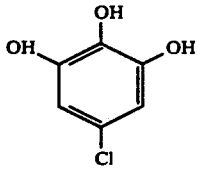
4-30
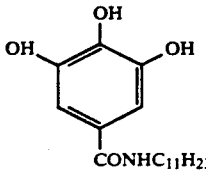

-continued

Exemplified compounds 4-31

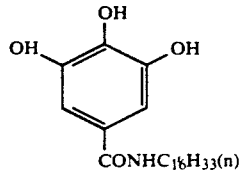

4-32

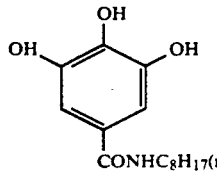

4-33

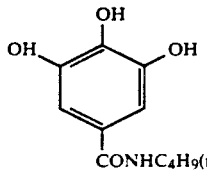

4-34

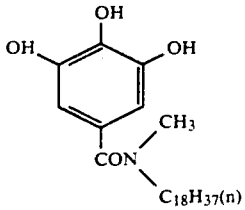

4-35

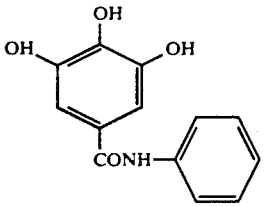

4-36

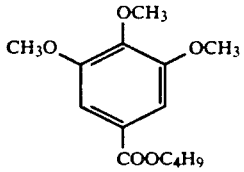

4-37

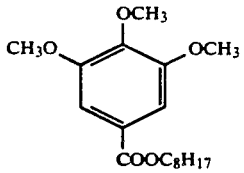

Formula 5

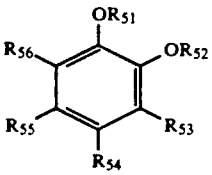

wherein $R_{51}$ and $R_{52}$ represent each a hydrogen or halogen atom or an alkyl group having 1 to 23 carbon atoms, and $R_{53}$, $R_{54}$, $R_{55}$ and $R_{56}$ represent each a hydrogen or halogen atom, an alkyl or alkoxy group having 1 to 23 carbon atoms, or a carboxyl, carboxyalkylester, hydroxyalkyl, hydroxyalkoxyalkyl, sulfo, amidoalkyl, amidophenyl, imidoalkyl or nitrile group.

The above-given groups each include those having a substituent. For example, a fluorinated alkyl group and an alkali metal substituted sulfo group may be used.

$R_{43}$, $R_{44}$, $R_{45}$ and $R_{46}$ are allowed to form a ring with each other and also to form a dimer with forming the ring.

Next, the typical compounds represented by the above Formula 5, which may be used in the invention, will now be exemplified below:

Exemplified compounds

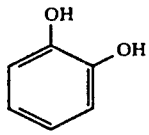

5-1

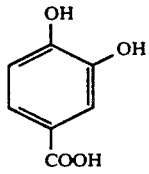

5-2

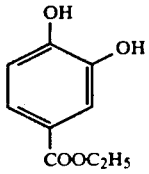

5-3

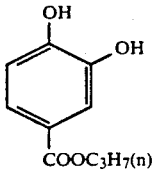

5-4

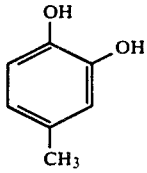

5-5

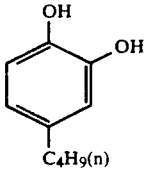

5-6

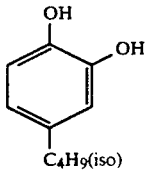

5-7

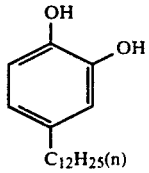

5-8

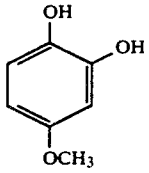

5-9

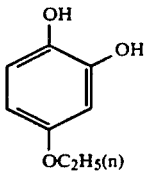

5-10

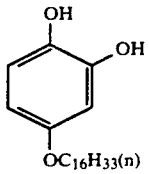

5-11

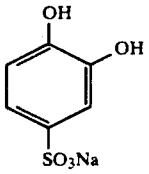

5-12

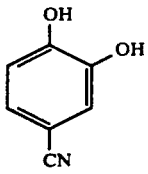

5-13

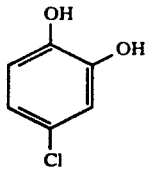

5-14

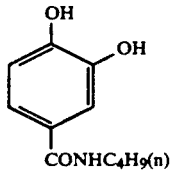

5-15

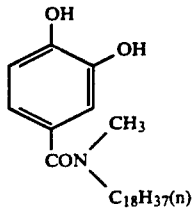

5-16

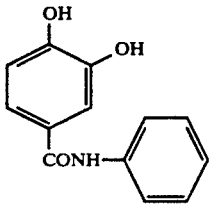

5-17

-continued

Exemplified compounds

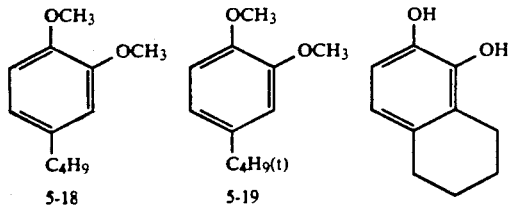

5-18 5-19 5-20

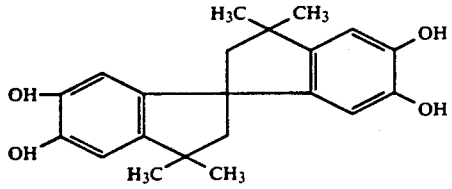

5-21

In each light-sensitive material of the invention, the contents of the compounds represented by Formula 4 or 5 are within the range of preferably $5\times10^{-6}$ to $5\times10^{-1}$ mols and more preferably $5\times10^{-5}$ to $1\times10^{-2}$ mols per mol of the silver halide contained in the light-sensitive material of the invention used. These compounds may be added at any time such as in the course of an emulsion preparation process and it is however more preferable to add them during or after a chemical ripening process.

The compounds of the invention represented by Formula 4 or 5 can be contained in a hydrphilic colloidal layer in, for example, a method that the compound of Formula 4 or 5 is added in the colloidal layer after it is dissolved in water and/or an appropriate organic solvent, another method that the solution of the compound of Formula 4 or 5 dissolved in an organic solvent is dispersed in gelatin or the hydrophilic colloidal matrix of a gelatin derivative and the resulting dispersion is added into the colloidal layer, and a further method that the compound of Formula 4 or 5 is dispersed in a latex and is then added into the colloidal layer. Among the compounds represented by Formula 4 or 5, the compounds represented by Formula 4 are particularly preferable to be used.

The light-sensitive materials of the invention are each comprised of at least one silver halide emulsion layer. To be more concrete, at least one of the silver halide emulsion layer is provided on to either one side or the both sides of the support of the light-sensitive material. The above-mentioned silver halide emulsion may be coated onto a support either directly or through the other layer such as a hydrophilic colloidal layer not containing any silver halide emulsion. It is also allowed to coat on the silver halide emulsion layer with a hydrophilic colloidal layer to serve as a protective layer. It is further allowed to coat on with silver halide emulsion layers each having the different speeds separately from each other, for example, one is high-speed and the other is low-speed in sensitivity. In this case, it is further allowed to provide an interlayer among the silver halide emulsion layers. In other words, an interlayer comprising hydrophilic colloid may be provided therebetween, if required. It is still further allowed to provide non-light-sensitive hydrophilic colloidal layers such as an interlayer, a protective layer, an antihalation layer and a backing layer other than the silver halide emulsion layer and the protective layer.

The compound represented by Formula 1, 2 or 3, and the compound represented Formula 4 or 5 are contained either in the silver halide emulsion layer of the light-sensitive materials of the invention or in the hydrophilic colloidal layers adjacent to the silver halide emulsion layer.

Next, the silver halides applicable to the light-sensitive materials of the invention will be detailed below. Silver halides having any compositions may be applied thereto. These silver halides include, for example, silver chloride, silver chlorobromide, silver chloroiodobromide, pure silver bromide or silver iodobromide.

However, the silver halides have an average grain-size within the range of, preferably, 0.05 to 0.5 μm and, inter alia, 0.10 to 0.40 μm.

In the silver halide grains applicable to the invention, any grain-size distribution can be selected. However, a value of monodispersion degrees defined below is adjusted to be within the range of, preferably, 1 to 30 and, more preferably, 5 to 20.

The term, a monodispersion degree, expressed herein is defined as a numeral value which is centuple the standard deviation value of a grain-size divided by an average grain-size value. For convenience, the grain-sizes of silver halide grains are expressed by an edge length in the case of cubic crystal grains and are calculated from the square root of a projective area of a grains in the case of the other grains such as octahedral or tetradeca hedral grains.

In the case of embodying the invention, it is allowed to use silver halide grains having such a multilayered structure as is comprised of at least two layers. For example, it is allowed to use silver iodobromide grains having the cores comprising silver iodobromide and the shells comprising silver bromide. In this case, an iodide may be contained in an amount of not more than 5 mol % in any one of layers.

To the silver halide grains applicable to the silver halide emulsions of the invention, metal ions may be added by making a metal salts such as cadmium salts, zinc salts, lead salts, thallium salts, iridium salts including the complex salts thereof, rhodium salts including the complex salts thereof and iron salts including the complex salts, in the course of forming and/or growing grains, so that these metal ions can be contained in the inside and/or the surface of each grain. It is also allowed to provide a reduction sensitization nucleus to the inside and/or the surface of each grain, by putting the grains in an appropriate reducing atmosphere.

In addition to the above, silver halides may be sensitized with various kinds of chemical sensitizers. The sensitizers include, for example, active gelatins, sulfur sensitizers such as sodium thiosulfate, allylthiocarbamide, thiourea and allylisothiacyanate, selenium sensitizers such as N,N-dimethylselenourea and selenourea, reduction sensitizers such as triethylenetetramine and stannous silver chloride, various noble metal sensitizers typically including potassium chloroaurite, potassium aurithiocyanate, potassium chloroaurate, 2-aurosulfobenzothiazole methyl chloride, ammonium chloropalladate, potassium chloroplatinate and sodium chloropalladite, and so forth. These sensitizers may be used independently or in combination. In the case of using the noble metal sensitizers, ammonium thiocyanate may also be used as an assistant.

The silver halide grains applicable to the invention can be preferably used as the so-called negative image providing silver halide grains each having a higher sensitivity on the surface thereof than in the inside. Therefore, when the grains are treated with the above-given sensitizers, the characteristics can be improved.

The silver halide emulsions applicable to the invention can also be stabilized or inhibited from producing fog by making use of mercapto compounds such as 1-phenyl-5-mercaptotetrazole and 2-mercaptobenzthiazole, benzotriazoles such as 5-bromobenzotriazole, 5-methylbenzotriazole, and benzimidazoles such as 6-nitrobenzimidazole.

Light-sensitive silver halide emulsion layers or the layers adjacent thereto may be added by the compounds disclosed in Research Disclosure No. 17463, Article XXI, Paragraphs B ~ D, with the purposes of increasing the sensitivity, heightening the contrast or accelerating the developability.

The above-mentioned compounds are preferably those represented by the Formula 6 given below.

Formula 6

$$R_{61}—O—CH_2CH_2O_nH$$

wherein $R_{61}$ represents a hydrogen atom or a non-substituted aromatic ring or an aromatic ring having a substituent, and n is an integer of 10 ~ 200.

The preferable examples of the compounds represented by Formula 6 will typically be given below. It is however to be understood that the invention shall not be limited thereto.

| | | |
|---|---|---|
| 6-1 | $HO(CH_2CH_2O)nH$ | n = 10 |
| 6-2 | $HO(CH_2CH_2O)nH$ | n = 30 |
| 6-3 | $HO(CH_2CH_2O)nH$ | n = 50 |
| 6-4 | $HO(CH_2CH_2O)nH$ | n = 70 |
| 6-5 | $HP(CH_2CH_2O)nH$ | n = 150 |
| 6-5 | $HO(CH_2CH_2O)nH$ | n = 200 |

6-7

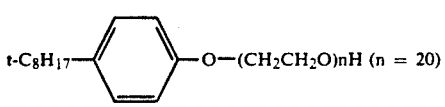

6-8

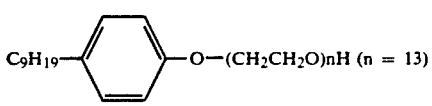

6-9

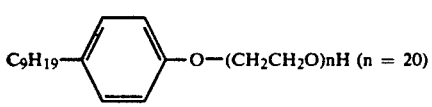

6-10

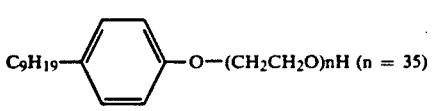

6-11

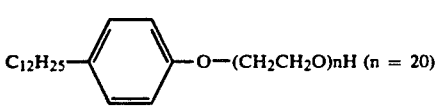

6-12

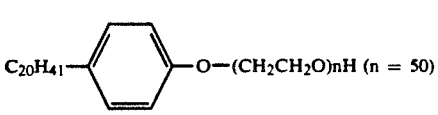

-continued 6-13

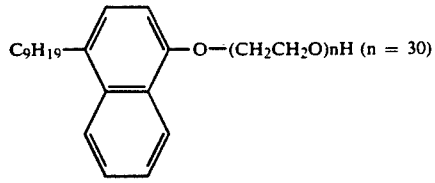

6-14

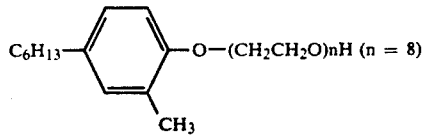

6-15

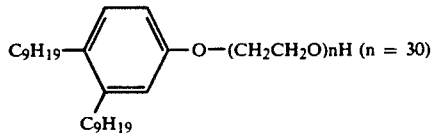

6-16

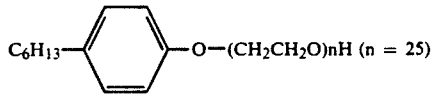

6-17

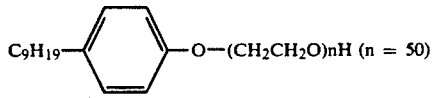

The above-given compounds may readily be available on the market. These compounds are added in an amount within the range of, preferably, 0.01 to 4.0 mols per mol of silver halides used and, more preferably, 0.02 to 2 mols. It is also permitted to add two or more kinds of the compounds of which n values are different from each other.

The silver halide emulsions applicable to the invention may be added with additives such as sensitizing dyes, plasticizers, antistatic agents, surfactants, hardeners. In the light-sensitive material of the invention, gelatin is preferably used for the binders of the hydrophilic colloidal layers. Besides the gelatin, any other hydrophilic colloids may also be used for. It is preferable to coat such hydrophilic binders in an amount of not more than 10 g/m$^2$ onto each of the both sides of a support. The supports applicable to embody the invention include, for example, a baryta paper, a polyethylene-coated paper, a polypropylene synthetic paper, a glass plate, a cellulose acetate film, a cellulose nitrate film and polyester films such as a polyethylene terephthalate film. Out of these kinds of the supports, any one may be suitably selected to meet the purposes of using silver halide photographic light-sensitive materials.

When processing the light-sensitive materials of the invention, the developing agents given below as the examples thereof may be used.

The typical examples of HO—(CH=CH)n—OH type developing agents include hydroquinone and, besides, catechol and pyrogallol.

HO—(CH=CH)n—$NH_2$ type developing agents typically include ortho- or para-aminophenol or aminopyrazolone and, besides, N-methyl-p-aminophenol, N-β-hydroxyethyl-p-aminophenol, phydroxyphenylaminoacetic acid and 2-aminonaphthol.

Heterocyclic type developing agents typically include 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4-methyl-4-hydroxymethyl-3-pyrazolidone.

Besides the above, it can be effective in the invention to use the developing agents such as those described in, for example, T. H. James, 'The Theory of the Photographic Process' 4th Ed. pp. 291-334 and 'Journal of the American Chemical Society', Vol 73, p. 3,100, 1951.

These developing agents may be used independently or in combination. It is, however, preferable to use two or more of them in combination.

In the developers applicable to developing the light-sensitive materials of the invention, any one of the effects of the invention may not be damaged even if preservatives are used, including, for example, sulfite salts such as sodium sulfite and potassium sulfite. Further, hydroxylamine and hydrazide compounds may also be used for the preservatives. Besides the above, it is free to adjust a pH value or to provide a buffering function with the use of alkali hydroxide, alkali carbonate or amine, and it is also free to add inorganic development inhibitors such as potassium bromide, organic development inhibitors such as 5-methylbenzotriazole, 5-methylbenzimidazole, 5-nitroindazole, adenine, guanine and 1-phenyl-5-mercaptotetrazole, metal-ion scavengers such as ethylenediaminetetraacetic acid, development accelerators such as methanol, ethanol, benzyl alcohol and polyalkylene oxide, surfactants such as sodium alkylarylsulfonate, natural saponin, a sugar or the alkyl-esters of the above-given compounds, hardeners such as glutaraldehyde, formalin and glyoxal, and ionicstrength adjusters such as sodium sulfate.

The developers applicable to the invention are allowed to contain organic solvents including, for example, alkanol amines such as diethanol amine and triethanol amine, or glycols such as diethylene glycol and triethylene glycol. Among them, in particular, alkylaminoalcohols such as diethylamino-1,2-propanediol and butylaminopropanol may preferably be contained therein.

EXAMPLES

Example 1

Preparation of Silver Halide Emulsion A

A silver iodobromide emulsion containing silver iodide in an amount of 2 mol % was prepared in a double-jet precipitation method. When mixing the emulsion, $K_2IrCl_6$ was added thereto in an amount of $6\times10^{-7}$ mols per mol of silver. The resulting emulsion was comprised of cubic crystal grains having an average grain-size of 0.20 μm and the mondispersion degrees of 10. After the emulsion was washed and desalted in ordinary methods, the pAg thereof was adjusted to be 8.80 at 40° C. with an aqueous potassium iodide solution. Further, the mixture of the following compounds A, B and C was added in the course of the redispersion.

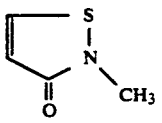

A

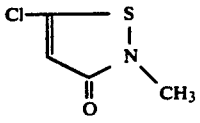

B

-continued

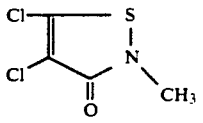

C

Preparation of Silver Halide Photographic Light-sensitive Material

Both sides of polyethyleneterephthalate film having a thickness of 100 μm were each coated thereon with an under-coat layer of 0.1 μm. (For further details, refer to Japanese Patent O.P.I. Publication No. 59-19941/1984.) Onto the under-coat layer on one side of the support, the silver halide emulsion layer having the following composition was coated so that the gelatin and silver contents thereof could be 2.0 g/m² and 3.5 g/m², respectively, and further thereon, the protective layer having the following composition was coated so that the gelatin content thereof could be 1.5 g/m². Onto the other opposite side of the under-coat layer, the backing layer having the following composition was coated so that the gelatin content thereof could be 2.7 g/m², and further thereon, the protective layer having the composition was coated so that the gelatin content thereof could be 1.0 g/m². Thus, Samples Nos. 1 through 27 were prepared.

| Composition of Silver Halide Emulsion Layer | |
|---|---|
| Gelatin | 2.0 g/m² |
| Silver halide emulsion A (in terms of silver content) | 3.5 g/m² |
| Antifoggant: 5-nitroindazole | 3 mg/m² |
| Stabilizer: 4-methyl-6-hydroxy-1,3,3a,7-tetrazindene | 30 mg/m² |
| Surfactant: Saponin | 0.1 g/m² |
| Accelerator: Examplified compound 6-4 | 100 mg/m² |
| Latex polymer: $\leftarrow CH-CH_{50}\leftarrow CH_2-CH_{50}$ ($COOC_4H_9$, $OCOCH_3$) | 0.5 g/m² |
| Compounds of the invention or a comparative compounds | See Table 1 |
| Sensitizing dye: | 8 mg/m² |

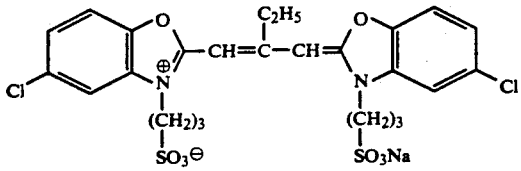

| Composition of Emulsion Protective Layer | |
|---|---|
| Gelatin | 1.5 g/m² |
| Matting agent: Silica having an average particle-size of 3.0-5.0 μm | 0.03 g/m² |
| Colloidal silica | 0.02 g/m² |
| Surfactant S: $CH_2COOCH_2(C_2H_5)C_4H_9$ / $CHCOOCH_2CH(C_2H_5)C_4H_9$ / $SO_3Na$ | 0.01 g/m² |
| Hardener: $(CH_2{=}CHSO_2CH_2)_2O$ | 0.10 g/m² |
| Composition of Backing Layer | |
| a | 40 mg/m² |

-continued

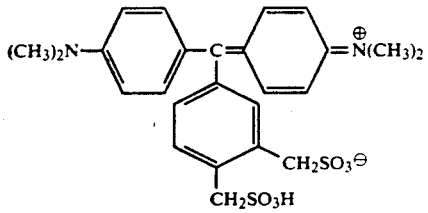

b 30 mg/m²

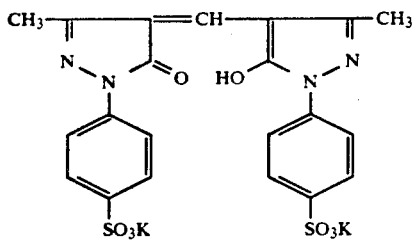

c 30 mg/m²

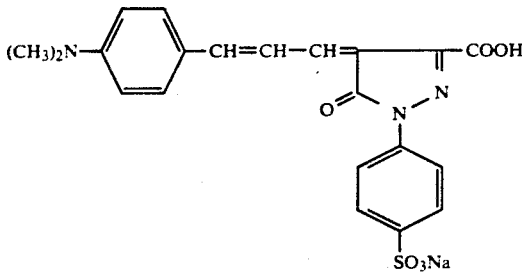

| | |
|---|---|
| Gelatin | 2.7 g/m² |
| Surfactant: Saponin | 0.1 g/m² |
| Hardener: Glyoxal | 0.1 g/m² |
| Sodium dodecylbenzenesulfonate | 0.01 g/m² |
| Composition of Backing Protective Layer | |
| Gelatin | 1 g/m² |
| Matting agent: Polymethyl methacrylate having an average particle-size of 3.0–5.0 μm | 0.05 g/m² |
| Surfactant S | 0.01 g/m² |
| Layer hardener: Glyoxal | 0.01 g/m² |

The resulting samples were subjected to the dot quality tests in the following method:

Method of Dot Quality Tests

A sample was brought into close contact with a step-wedge having partly been attached thereto with a 150 lines/- inch dot contact-screen. Each of the samples was exposed for 5 seconds to a xenon lamp and was then processed under the following conditions through a rapid processing automatic processor into which the following developer and fixer were put in. After the samples were each processed, the dot quality of each sample was observed through a 100X magnifier.

The resulting dot qualities were ranked by five grades. Grade 5 was given to the excellent dot quality and grades 4, 3, 2 and 1 were given to the dot qualities in order from the quality next to the excellent to the poorest, respectively. Among these grades, the qualities of grades 1 and 2 were not on the preferable level for practical application.

Pepper fog produced in the halftone dots were similarly evaluated. The highest grade 5 was given to the resulting dots having no pepper fog at all and grades 4, 3, 2 and 1 were given to the dots in order from the quality next to the highest to the lower, respectively. Among these grades, the pepper fog production evaluated by grades 1 and 2 were not on the preferable level for practical application.

The resulting samples were measured with KONICA Digital Densitometer Model PDP-65, and the sensitivity values of the samples were expressed by the values relative to the sensitivity of Sample No. 1, which was obtained at a density of 3.0 and set at a value of 100. Further, the gamma values were expressed by a tangent value of a line conecting the point of density of 0.3 to a density of 3.0.

| | |
|---|---|
| Composition Formula of Developer | |
| Disodium ethylenediaminetetraacetate | 1 g |
| Sodium sulfite | 60 g |
| Hydroquinone | 35 g |
| 5-amino-1-pentanol | 50 g |
| Potassium bromide | 2.5 g |
| 5-methylbenzotriazole | 0.3 g |
| 1-phenyl-3-pyrazolidone | 0.2 g |
| Add water to make | 1 liter |
| Adjust pH with sodium hydroxide to be | pH 11.5 |
| Composition Formula of Fixer | |
| Composition A | |
| Ammonium thiosulfate, in an aqueous 72.5% w/v solution | 240 ml |
| Sodium sulfite | 17 g |
| Sodium acetate.trihydrate | 6.5 g |
| Boric acid | 6 g |
| Sodium citrate.dihydrate | 2 g |
| Composition B | |
| Pure water, i.e., ion-exchange water | 17 ml |
| Sulfuric acid, in an aqueous 50% w/w solution | 4.7 g |
| Aluminium sulfate, an aqueous 8.1% w/w solution contained in terms of $Al_2O_3$ | 26.5 g |

When using the fixer, the above-given Compositions A and B were dissolved in order in 500 ml of water, respectively, and then made it to be one liter, and the fixer was used. The pH of the fixer was adjusted to be 4.3 with acetic acid.

| Processing Conditions | | |
|---|---|---|
| Processing step | Processing temperature | Processing time |
| Developing | 40° C. | 15 seconds |
| Fixing | 35° C. | 15 seconds |
| Washing | 30° C. | 10 seconds |
| Drying | 50° C. | 10 seconds |

For the comparative compounds added to the silver halide emulsion layer having the foregoing composition, the Compounds a through d were used.

a

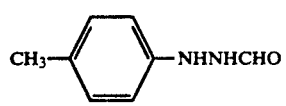

b

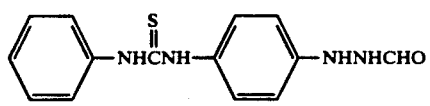

c

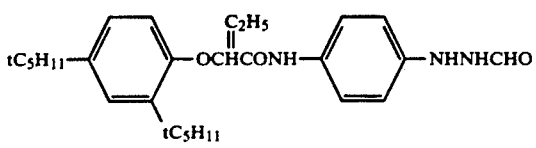

-continued d

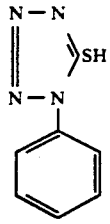

The results of the above-described examples are shown in Table 1.

As is obvious from Table 1, it can be found that Samples Nos. 10 through 27 were high in contrast and excellent in halftone dot quality and in pepper fog production prevention, as well as higher in sensitivity than in the comparative examples.

TABLE 1

| Sample No. | Compounds of Formulas 1-3 No. | Compounds of Formulas 1-3 Amount added | Compound of Formulas 4-5 No. | Compound of Formulas 4-5 Amount added | Relative sensitivity | Gamma | Dot quality | Pepper fog | |
|---|---|---|---|---|---|---|---|---|---|
| 1 | a | 15 | — | — | 100 | 4.5 | 3 | 2 | Comparative |
| 2 | b | 15 | — | — | 101 | 5.2 | 3 | 2 | Comparative |
| 3 | c | 15 | — | — | 105 | 5.5 | 3 | 2 | Comparative |
| 4 | 1-10 | 15 | — | — | 106 | 9.8 | 5 | 2 | Comparative |
| 5 | 2-57 | 15 | — | — | 108 | 10.5 | 5 | 2 | Comparative |
| 6 | 3-3 | 15 | — | — | 108 | 10.4 | 5 | 2 | Comparative |
| 7 | 1-10 | 15 | d | 20 | 40 | 7.5 | 4 | 5 | Comparative |
| 8 | 2-57 | 15 | d | 20 | 45 | 8.4 | 4 | 5 | Comparative |
| 9 | 3-3 | 15 | d | 20 | 45 | 8.4 | 4 | 5 | Comparative |
| 10 | 1-10 | 15 | 4-5 | 20 | 105 | 9.7 | 5 | 5 | Invention |
| 11 | 2-57 | 15 | 4-1 | 20 | 107 | 10.5 | 5 | 5 | Invention |
| 12 | 2-57 | 15 | 4-5 | 20 | 110 | 10.5 | 5 | 5 | Invention |
| 13 | 2-57 | 15 | 4-23 | 20 | 108 | 10.5 | 5 | 5 | Invention |
| 14 | 3-3 | 15 | 4-1 | 20 | 107 | 10.5 | 5 | 5 | Invention |
| 15 | 3-3 | 15 | 4-5 | 20 | 110 | 10.5 | 5 | 5 | Invention |
| 16 | 3-35 | 15 | 4-5 | 20 | 110 | 10.4 | 5 | 5 | Invention |
| 17 | 3-35 | 15 | 4-25 | 20 | 108 | 10.5 | 5 | 5 | Invention |
| 18 | 3-35 | 15 | 4-33 | 25 | 108 | 10.4 | 5 | 5 | Invention |
| 20 | 2-57 | 15 | 5-1 | 20 | 106 | 10.6 | 5 | 5 | Invention |
| 22 | 2-57 | 15 | 5-10 | 20 | 105 | 10.6 | 5 | 5 | Invention |
| 23 | 3-3 | 15 | 5-4 | 20 | 105 | 10.6 | 5 | 5 | Invention |
| 26 | 3-35 | 15 | 5-14 | 20 | 104 | 10.6 | 5 | 5 | Invention |
| 27 | 3-35 | 15 | 4-21 | 25 | 104 | 10.5 | 5 | 5 | Invention |

Unit of the amounts of the compounds added: $mg/m^2$

Example 2

The preparation was made in the same manner as in Example 1, except that the following silver halide emulsion B was used and the processing was made with the developer having the following composition. The results of the example are shown in Table 2.

Preparation of Silver Halide Emulsion B

A silver iodobromide emulsion containing silver iodide in an amount of 0.5 mol% in a double-jet precipitation method. When mixing the emulsion, $K_2IrCl_6$ was added in an amount of $6\times10^{-7}$ mols per mol of silver. The resulting emulsion was comprised of cubic crystals having an average grain-size of 0.20 μm. The resulting emulsion was washed and desalted in an ordinary method and was then sulfur-sensitized at 62° C. for 90 minutes. The pAg of the emulsion was adjusted to be 7.90 at a temperature of 40° C. with the use of an aqueous potassium iodide solution.

| Composition Formula of Developer | |
|---|---|
| Hydroquinone | 22.5 g |
| Metol | 0.25 g |
| Ethylenediaminetetraacetic acid | 1.0 g |
| Sodium sulfite | 75.0 g |
| Sodium hydroxide | 7.9 g |
| Triodium phosphate dodecahydrate | 75.0 g |
| 5-methylbenzotriazole | 0.25 g |
| N,N-diethylethanolamine | 12.5 ml |
| Add water to make | 1 liter |
| Adjust pH to be | pH 11.6 |

The results of the above example are shown in Table 2.

As is obvious from Table 2, it can be found that, similar to the case of Example 1, Samples Nos. 37 through 54 each relating to the invention were high in contrast and excellent in pepper fog production prevention, as well as higher in sensitivity than in the comparative samples.

TABLE 2

| Sample No. | Compounds of Formulas 1-3 No. | Compounds of Formulas 1-3 Amount added | Compound of Formulas 4-5 No. | Compound of Formulas 4-5 Amount added | Relative sensitivity | Gamma | Dot quality | Pepper fog | |
|---|---|---|---|---|---|---|---|---|---|
| 28 | a | 15 | — | — | 100 | 5.5 | 3 | 2 | Comparative |
| 29 | b | 15 | — | — | 101 | 5.8 | 3 | 2 | Comparative |
| 30 | c | 15 | — | — | 104 | 6.0 | 3 | 2 | Comparative |
| 31 | 1-5 | 15 | — | — | 105 | 10.3 | 5 | 2 | Comparative |
| 32 | 2-57 | 15 | — | — | 107 | 11.0 | 5 | 2 | Comparative |
| 33 | 3-3 | 15 | — | — | 107 | 11.0 | 5 | 2 | Comparative |
| 34 | 1-5 | 15 | d | 20 | 40 | 8.0 | 4 | 5 | Comparative |
| 35 | 2-57 | 15 | d | 20 | 42 | 8.2 | 4 | 5 | Comparative |

TABLE 2-continued

| Sample No. | Compounds of Formulas 1-3 No. | Amount added | Compound of Formulas 4-5 No. | Amount added | Relative sensitivity | Gamma | Dot quality | Pepper fog | |
|---|---|---|---|---|---|---|---|---|---|
| 36 | 3-3 | 15 | d | 20 | 42 | 8.2 | 4 | 5 | Comparative |
| 37 | 1-5 | 15 | 4-5 | 20 | 103 | 10.4 | 5 | 5 | Invention |
| 38 | 2-57 | 15 | 4-1 | 20 | 105 | 11.2 | 5 | 5 | Invention |
| 39 | 2-57 | 15 | 4-5 | 20 | 108 | 11.5 | 5 | 5 | Invention |
| 40 | 2-57 | 15 | 4-24 | 20 | 105 | 11.0 | 5 | 5 | Invention |
| 41 | 3-3 | 15 | 4-1 | 20 | 105 | 11.2 | 5 | 5 | Invention |
| 42 | 3-3 | 15 | 4-5 | 20 | 108 | 11.5 | 5 | 5 | Invention |
| 43 | 3-35 | 15 | 4-5 | 20 | 108 | 11.5 | 5 | 5 | Invention |
| 44 | 3-35 | 15 | 4-25 | 20 | 105 | 11.1 | 5 | 5 | Invention |
| 45 | 3-35 | 15 | 4-33 | 25 | 105 | 11.3 | 5 | 5 | Invention |
| 47 | 2-57 | 15 | 5-1 | 20 | 103 | 11.3 | 5 | 5 | Invention |
| 48 | 2-57 | 15 | 5-7 | 20 | 106 | 11.5 | 5 | 5 | Invention |
| 49 | 2-57 | 15 | 5-10 | 20 | 103 | 11.0 | 5 | 5 | Invention |
| 50 | 3-3 | 15 | 5-4 | 20 | 103 | 11.3 | 5 | 5 | Invention |
| 53 | 3-35 | 15 | 5-13 | 20 | 103 | 11.3 | 5 | 5 | Invention |
| 54 | 3-35 | 15 | 5-21 | 25 | 102 | 11.4 | 5 | 5 | Invention |

Unit of the amounts of the compounds added: $mg/m^2$

What is claimed is:

1. A silver halide photographic light-sensitive material comprising a support and a silver halide emulsion layer, wherein said silver halide emulsion layer or a layer adjacent to said silver halide emulsion layer contains:

a compound selected from compounds of the following formulas (1), (2) and (3):

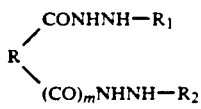

(1)

wherein $R_1$ and $R_2$ are each an aryl group or a heterocyclic group, R is a simple linking bond or a divalent organic group, and m is zero or 1;

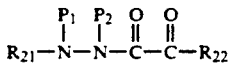

(2)

wherein $R_{21}$ is an aliphatic group, an aromatic group or a heterocyclic group, $R_{22}$ is a hydrogen atom, or a substitutable alkoxy, heterocyclic oxy, amino or aryloxy group, and $P_1$ and $P_2$ are each a hydrogen atom, an acyl group or a sulfinic acid group;

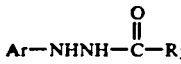

(3)

wherein Ar is an aryl group which contains an anti-diffusion group or an absorption accelerating group to silver halide, and $R_{31}$ is a substituted alkyl group;

(ii) a compound of the following formula (4):

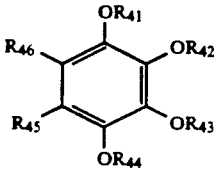

(4)

wherein $R_{41}$, $R_{42}$ and $R_{43}$ are each a hydrogen atom, a halogen atom or an alkyl group having 1 to 23 carbon atoms, and $R_{44}$, $R_{45}$ and $R_{46}$ are each a hydrogen atom, a halogen atom, an alkyl group having 1 to 23 carbon atoms, an alkoxy group having 1 to 23 carbon atoms, a carboxyl group, a carboxylalkyl ester group, a hydroxyalkyl group, a hydroxyalkoxyalkyl group, a sulfo group, an amidoalkyl group, an amidophenyl group, an imidoalkyl group or a nitrile group; and (iii) a compound of the following formula (6):

$$R_{61}—O—CH_2C_2O_nH \quad (6)$$

wherein $R_{61}$ is a hydrogen atom or a substituted or unsubstituted aromatic group, and n is an integer of 10 to 200.

2. A silver halide photographic light-sensitive material as recited in claim 1, wherein said compound selected from compounds of the formulas (1), (2) and (3) is present in an amount of from $5\times10^{-7}$ to $5\times10^{-1}$ mols per mol of silver halide in the silver halide emulsion layer.

3. A silver halide photographic light-sensitive material as recited in claim 1, wherein said compound selected form compounds of the formulas (1), (2) and (3) is present in an amount of from $5\times10^{-6}$ to $1\times10^{-2}$ mols per mol of silver halide in the silver halide emulsion layer.

4. A silver halide photographic light-sensitive material as recited in claim 1, wherein said compound of the formula (4) is present in an amount of from $5\times10^{-6}$ to $5\times10^{-1}$ mols per mol of silver halide in the silver halide emulsion layer.

5. A silver halide photographic light-sensitive material as recited in claim 1, wherein said compound of the formula (4) is present in an amount of from $5\times10^{-5}$ to $1\times10^{-2}$ mols per mol of silver halide in the silver halide emulsion layer.

6. A silver halide photographic light-sensitive material as recited in claim 1, wherein said compound of the formula (6) is present in an amount 0.01 to 4.0 mols per mol of silver halide in the silver halide emulsion layer.

7. A silver halide photographic light-sensitive material as recited in claim 1, wherein said compound of the formula (6) is present in an amount 0.02 to 2.0 mols per mol of silver halide in the silver halide emulsion layer.

8. A silver halide photographic light-sensitive material comprising a support and a silver halide emulsion layer, wherein said silver halide emulsion layer or a layer adjacent to said silver halide emulsion layer contains:

(i) a compound selected from compounds of the following formulas (1), (2) and (3):

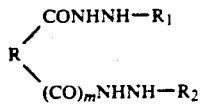

(1)

wherein $R_1$ and $R_2$ are each an aryl group or a heterocyclic group, R is a simple linking bond or a divalent organic group, and m is zero or 1;

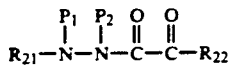

(2)

wherein $R_{21}$ is an aliphatic group, an aromatic group or a heterocyclic group, $R_{22}$ is a hydrogen atom, or a substitutable alkoxy, heterocyclic oxy, amino or aryloxy group, and $P_1$ and $P_2$ are each a hydrogen atom, an acyl group or a sulfinic acid group;

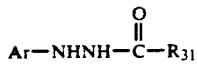

(3)

wherein Ar is an aryl group which contains an anti-diffusion group or an absorption accelerating group to silver halide, and $R_{31}$ is a substituted alkyl group;

(ii) a compound of the following formula (5):

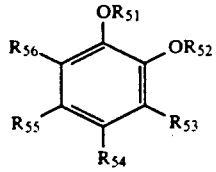

(5)

wherein $R_{51}$ and $R_{52}$ are each a hydrogen atom, a halogen atom or an alkyl group having 1 to 23 carbon atoms, and $R_{53}$, $R_{54}$, $R_{55}$ and $R_{56}$ are each a hydrogen atom, a halogen atom, an alkyl group having 1 to 23 carbon atoms, an alkoxy group having 1 to 23 carbon atoms, a carboxyl group, a carboxylalkyl ester group, a hydroxyalkyl group, a hydroxyalkoxyalkyl group, a sulfo group, an amidoalkyl group, an amidophenyl group, an imidoalkyl group or a nitril group; and (iii) a compound of the following formula (6):

$$R_{61}—O—CH_2CH_2O_nH \quad (6)$$

wherein $R_{61}$ is a hydrogen atom or a substituted or unsubstituted aromatic group, and n is an integer of 10 to 200.

9. A silver halide photographic light-sensitive material as recited in claim 8, wherein said compound selected form compounds of the formulas (1), (2) and (3) is present in an amount of from $5\times10^{-7}$ to $5\times10^{-1}$ mols per mol of silver halide in the silver halide emulsion layer.

10. A silver halide photographic light-sensitive material as recited in claim 8, wherein said compound selected form compounds of the formulas (1), (2) and (3) is present in an amount of from $5\times10^{-6}$ to $1\times10^{-2}$ mols per mol of silver halide in the silver halide emulsion layer.

11. A silver halide photographic light-sensitive material as recited in claim 8, wherein said compound of the formula (5) is present in an amount of from $5\times10^{-6}$ to $5\times10^{-1}$ mols per mol of silver halide in the silver halide emulsion layer.

12. A silver halide photographic light-sensitive material as recited in claim 8, wherein said compound of the formula (5) is present in an amount of from $5\times10^{-5}$ to $1\times10^{-2}$ mols per mol of silver halide in the silver halide emulsion layer.

13. A silver halide photographic light-sensitive material as recited in claim 8, wherein said compound of the formula (6) is present in an amount 0.01 to 4.0 mols per mol of silver halide in the silver halide emulsion layer.

14. A silver halide photographic light-sensitive material as recited in claim 8, wherein said compound of the formula (6) is present in an amount 0.02 to 2.0 mols per mol of silver halide in the silver halide emulsion layer.

* * * * *

UNITED STATES PATENT AND TRADEMARK OFFICE
CERTIFICATE OF CORRECTION

ATENT NO. : 5,130,226

ATED : July 14, 1992

VENTOR(S) : Takeshi SAMPEI et al.

It is certified that error appears in the above-identified patent and that said Letters Patent is hereby orrected as shown below:

TITLE PAGE:

Item [30], Foreign Application Priority Data, insert (as additional):

--Jul. 3, 1989 [JP] Japan----------1-172577--.

Abstract, formula (4), change

" 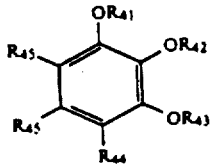 " to -- 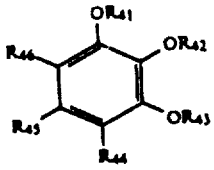 --.

Abstract, second line from the bottom, change "usung" to --using--.

Claim 1, column 67, line 27, before "a" insert --(i)--.

Claim 1, column 67, line 60, change

" 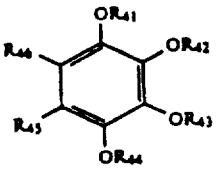 " to -- 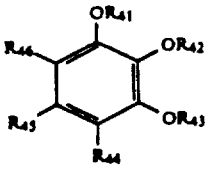 --.

UNITED STATES PATENT AND TRADEMARK OFFICE
CERTIFICATE OF CORRECTION

ATENT NO. : 5,130,226

ATED : July 14, 1992

IVENTOR(S) : Takeshi SAMPEI et al.

It is certified that error appears in the above-identified patent and that said Letters Patent is hereby orrected as shown below:

Claim 1, column 68, line 31, change "$R_{61}$-O-$CH_2C_2O_nH$" to --$R_{61}$-O-$(CH_2CH_2O)_n$-H--.

Claim 3, column 68, line 44, change "form" to --from--.

Claim 8, column 70, line 9, change "$R_{61}$-O-$CH_2CH_2O_nH$" to --$R_{61}$-O-$(CH_2CH_2O)_n$-H--.

Claim 9, column 70, line 16, change "form" to --from--.

Claim 10, column 70, line 22, change "form to --from--.

Signed and Sealed this

Twenty-eighth Day of September, 1993

Bruce Lehman

*Attest:*

BRUCE LEHMAN

*Attesting Officer*

*Commissioner of Patents and Trademarks*